US007780040B2

(12) United States Patent
Wegman

(10) Patent No.: US 7,780,040 B2
(45) Date of Patent: Aug. 24, 2010

(54) PARTICLE DISPENSER CARTRIDGE ARRANGED WITH DISPENSER NOZZLE OUTER SHUTTER RAILS

(75) Inventor: Paul M. Wegman, Pittsford, NY (US)

(73) Assignee: Xerox Corporation, Norwalk, CT (US)

( * ) Notice: Subject to any disclaimer, the term of this patent is extended or adjusted under 35 U.S.C. 154(b) by 729 days.

(21) Appl. No.: 11/079,871

(22) Filed: Mar. 14, 2005

(65) Prior Publication Data

US 2006/0201971 A1 Sep. 14, 2006

(51) Int. Cl.
*B65D 83/06* (2006.01)

(52) U.S. Cl. ..... 222/162; 222/555; 222/325; 222/DIG. 1; 222/560; 222/561; 399/106; 399/120; 399/260; 399/262; 141/364

(58) Field of Classification Search ..... 222/DIG. 1, 222/162, 325, 559–561, 555; 141/364; 399/106, 399/119, 120, 258, 260, 262, 263
See application file for complete search history.

(56) References Cited

U.S. PATENT DOCUMENTS 4,937,628 A * 6/1990 Cipolla et al. ..... 399/106
4,981,218 A * 1/1991 Ban et al. ..... 229/123.1
5,585,902 A * 12/1996 Nishiuwatoko et al. ..... 399/106
6,438,345 B1 * 8/2002 Ban et al. ..... 399/262
6,766,133 B1 * 7/2004 Ban et al. ..... 399/258
6,842,595 B1 * 1/2005 McIver et al. ..... 399/106

* cited by examiner

*Primary Examiner*—J. Casimer Jacyna
(74) *Attorney, Agent, or Firm*—Gibb I.P. Law Firm, LLC

(57) ABSTRACT

A cylindrical-shaped particle dispenser cartridge includes a dispenser nozzle. The dispenser nozzle outer surface includes sealing ribs that surround an included nozzle opening. The dispenser nozzle is arranged to engage a shutter that slides over the sealing ribs, thus sealing the nozzle opening. When the cartridge rotates about the cartridge axial in a shutter-opening or leading direction (X) with respect to the shutter, the sealing ribs move in a like direction with respect to the shutter, thus unsealing the particle dispenser cartridge nozzle opening. The dispenser cartridge is arranged to dispense particles such as, for example, toner particles. The dispenser nozzle outer surface includes outer shutter rails disposed on inboard and outboard sides of the sealing ribs.

17 Claims, 15 Drawing Sheets

PARTICLE DISPENSER CARTRIDGE ARRANGED WITH DISPENSER NOZZLE OUTER SHUTTER RAILS

BACKGROUND OF THE INVENTION

Referring now to FIG. 1 there is a detached elevated perspective view of an existing cylindrical-shaped particle dispenser cartridge 100 in a particle dispenser 10. The cartridge 100 includes an axial 101 and a dispenser nozzle 200. The dispenser nozzle 200, in turn, includes a dispenser nozzle outer surface 210. For good understanding, the reference number 210 is shown in FIG. 2, which figure is discussed below.

As shown in FIG. 1, the dispenser nozzle outer surface 210 includes plural sealing ribs 220 surrounding an included particle dispenser cartridge nozzle opening 120. In turn, the plural sealing ribs 220 include an outer sealing rib 230 and an inner sealing rib 240.

Still referring to FIG. 1, the dispenser nozzle 200 is arranged to engage a shutter 300. FIG. 1 depicts the shutter 300 in a "closed" position with respect to the nozzle opening 120. A reference line 91 is orthogonal to the axial 101, parallel to the cartridge inboard end 105 and intersects the shutter outer surface 310. In FIG. 1, as well as in FIGS. 2-6 described below, an included radial arrow "Y" originates at and is orthogonal to the axial 101 and extends through the center of the nozzle opening 120. In FIG. 1 the radial arrow Y is further labeled with the subscript "1", thus "Y1".

Referring now to FIG. 2, the cartridge 100 is rotated about the axial 101 by an angular amount "Z" with respect to the stationary shutter 300. As a result of such rotation by the cartridge 100, FIG. 2 thus depicts the shutter 300 in an "open" position with respect to the nozzle opening 120. In FIG. 2 the radial arrow Y is further labeled with the subscript "2", thus "Y2".

Referring now to FIG. 3, there is a further view of the shutter 300 in a "closed" position with respect to the nozzle opening 120, as described earlier in connection with FIG. 1 above. As shown in FIG. 3, the shutter 300 includes an inner shutter sealing surface 320 arranged to slide over the plural sealing ribs, thus sealing the particle dispenser cartridge nozzle opening 120. For example, as shown in FIG. 3, in one embodiment, the shutter 300 is held stationary with respect to the cartridge axial 101 by the particle dispenser housing 11 and 12. As the FIG. 3 shutter 300 "closed" position view corresponds to the earlier FIG. 1 view, the radial arrow Y in FIG. 3 likewise is labeled with the subscript "1", thus "Y1".

Referring now to FIGS. 4-5, with the shutter 300 stationary with respect to the cartridge axial 101, when the cartridge 100 rotates in a shutter-opening or leading direction (X) with respect to the shutter 300, the plural sealing ribs 220 slide or move in a like direction with respect to the shutter sealing surface 320 to thus unseal the particle dispenser cartridge nozzle opening 120.

Referring now to FIG. 4, there is depicted the cartridge 100 rotated in the direction X by an initial angular amount such that the shutter sealing surface 320 no longer contacts the leading edge 221 of the plural sealing ribs 220.

Referring now to FIG. 5, there is a further view of the shutter 300 in an "open" position with respect to the nozzle opening 120, as described earlier in connection with FIG. 2 above. As shown in FIG. 5, the cartridge 100 is rotated in the direction X by the total angular amount Z, the angular amount Z being depicted in FIG. 2. As a result of such cartridge 100 rotation, the shutter sealing surface 320 now no longer covers the leading edge 121 of the cartridge nozzle opening 120. As a result, particles 2 present in the particle dispenser cartridge nozzle outlet conduit 114 now flow 3 into the inlet conduit 14 of the particle dispenser 10. As the FIG. 5 shutter 300 "open" position view corresponds to the earlier FIG. 2 view, the radial arrow Y in FIG. 5 likewise is labeled with the subscript "2", thus "Y2".

Referring now to FIG. 6, with the shutter 300 stationary with respect to the cartridge axial 101, when the cartridge 100 now rotates in the opposite shutter-closing or trailing direction (X') with respect to the shutter 300, the plural sealing ribs 220 slide or move in a like direction with respect to the shutter sealing surface, thereby now sealing the nozzle opening 120. As a result, the particle flow 3 of FIG. 5 now ceases.

Unfortunately, the cartridge 100 sometimes hangs-up in the dispenser 10. This hang-up problem occurs due to an interference between the short cartridge sealing ribs, that is, the leading sealing ribs 221 and the trailing sealing ribs 222, surrounding the cartridge nozzle opening 120 and an insert in the dispenser 10. This hang-up problem occurs more frequently when the dispenser 10 is misassembled or worn. This hang-up problem occurs upon installing the cartridge 100 in the dispenser 10, removing the cartridge 100 from the dispenser 10, or both. Also, the cartridge 100 sometimes hangs-up because of a small difference in the height and shape of the sealing ribs 220.

In the past, this cartridge 100 hang-up problem has required a field service technician to be dispatched to change-out the defective dispenser 10.

Thus, there is a need for an improved particle dispenser cartridge.

BRIEF SUMMARY OF THE INVENTION

In a first aspect of the invention, substantially corresponding to the invention that is described in the claim presented below as claim number 1, there is described a particle dispenser cartridge having a dispenser nozzle, the dispenser nozzle having one or more sealing ribs surrounding an included particle dispenser cartridge nozzle opening, the dispenser nozzle arranged to engage a shutter, the shutter arranged to slide over the one or more sealing ribs, thus sealing the particle dispenser cartridge nozzle opening, the dispenser nozzle further arranged so that when the particle dispenser cartridge rotates about the particle dispenser cartridge axial in a shutter-opening or leading direction (X) with respect to the shutter, the one or more sealing ribs move in a like direction with respect to the shutter, thus unsealing the particle dispenser cartridge nozzle opening; the dispenser nozzle having a first dispenser nozzle outer shutter rail disposed on an inboard side of the one or more sealing ribs and a second dispenser nozzle outer shutter rail disposed on the opposite outboard side of the one or more sealing ribs, with each of the first and second dispenser nozzle outer shutter rails having a leading rail end that extends beyond the leading edge of the one or more sealing ribs in the shutter-opening direction (X).

In a second aspect of the invention, substantially corresponding to the invention that is described in the claim presented below as claim number 9, there is described a particle dispenser cartridge having a dispenser nozzle, the dispenser nozzle having one or more sealing ribs surrounding an included particle dispenser cartridge nozzle opening, the dispenser nozzle arranged to engage a shutter, the shutter arranged to slide over the one or more sealing ribs, thus sealing the particle dispenser cartridge nozzle opening, the dispenser nozzle further arranged so that when the particle dispenser cartridge rotates about the particle dispenser cartridge axial in a shutter-opening or leading direction (X) with respect to the shutter, the one or more sealing ribs move in a like direction with respect to the shutter, thus unsealing the particle dispenser cartridge nozzle opening; the dispenser nozzle having four dispenser nozzle outer shutter rails, with a first and a third dispenser nozzle outer shutter rails disposed on an inboard side of the one or more sealing ribs, and a second and a fourth dispenser nozzle outer shutter rails disposed on the opposite outboard side of the one or more sealing ribs, with each of the first and second dispenser nozzle outer shutter rails having a leading rail end that extends beyond the leading edge of the one or more sealing ribs in the shutter-opening direction (X), and each of the third and fourth dispenser nozzle outer shutter rails having a trailing rail end that extends beyond the trailing edge of the one or more sealing ribs in the opposite shutter-closing or trailing direction (X').

In a third aspect of the invention, substantially corresponding to the invention that is described in the claim presented below as claim number 16, there is described a particle dispenser cartridge having a dispenser nozzle, the dispenser nozzle having one or more sealing ribs surrounding an included particle dispenser cartridge nozzle opening, the dispenser nozzle arranged to engage a shutter, the shutter arranged to slide over the one or more sealing ribs, thus sealing the particle dispenser cartridge nozzle opening, the dispenser nozzle further arranged so that when the particle dispenser cartridge rotates about the particle dispenser cartridge axial in a shutter-opening or leading direction (X) with respect to the shutter, the one or more sealing ribs move in a like direction with respect to the shutter, thus unsealing the particle dispenser cartridge nozzle opening; the dispenser nozzle having a first dispenser nozzle outer shutter rail disposed on an inboard side of the one or more sealing ribs and a second dispenser nozzle outer shutter rail disposed on the opposite outboard side of the one or more sealing ribs, each of the first and second dispenser nozzle outer shutter rails having a leading rail end, an opposite trailing rail end, and a shutter rail length therebetween, with each leading rail end of the first and second dispenser nozzle outer shutter rails extending beyond the leading edge of the one or more sealing ribs in the shutter-opening direction (X) and each trailing rail end of the first and second dispenser nozzle outer shutter rails extending beyond the trailing edge of the one or more sealing ribs in the opposite shutter-closing or trailing direction (X').

In a fourth aspect of the invention, substantially corresponding to the invention that is described in the claim presented below as claim number 23, there is described a particle dispenser cartridge having a dispenser nozzle, the dispenser nozzle having plural sealing ribs surrounding an included particle dispenser cartridge nozzle opening, the dispenser nozzle arranged to engage a shutter, the shutter arranged to slide over the plural sealing ribs, thus sealing the particle dispenser cartridge nozzle opening, the dispenser nozzle further arranged so that when the particle dispenser cartridge rotates about the particle dispenser cartridge axial in a shutter-opening or leading direction (X) with respect to the shutter, the plural sealing ribs move in a like direction with respect to the shutter, thus unsealing the particle dispenser cartridge nozzle opening; the dispenser nozzle having a first dispenser nozzle outer shutter rail disposed on an inboard side of the plural sealing ribs and a second dispenser nozzle outer shutter rail disposed on the opposite outboard side of the plural sealing ribs, each of the first and second dispenser nozzle outer shutter rails having a leading rail end, an opposite trailing rail end, and a shutter rail length therebetween, with each leading rail end of the first and second dispenser nozzle outer shutter rails extending in the shutter-opening or leading direction (X) substantially to the leading edge of an included dispenser nozzle outer surface, and each trailing rail end of the first and second dispenser nozzle outer shutter rails extending in the opposite shutter-closing or trailing direction (X') substantially to the trailing edge of the dispenser nozzle outer surface.

BRIEF DESCRIPTION OF THE SEVERAL VIEWS OF THE DRAWING

In FIGS. 1-2, an included reference line 91, also depicted in FIGS. 3-6 described below, is depicted as orthogonal to the cartridge axial 101, parallel to the cartridge inboard end 105 and coincident with the shutter outer surface 310. Also in FIGS. 1-2, an included radial arrow "Y", also depicted in FIGS. 3-6 described below, is depicted as originating at the axial 101, orthogonal to the axial 101, and extending through the center of the nozzle opening 120.

As shown in FIG. 7, the cylindrical-shaped particle dispenser cartridge 400 is arranged to be installed and used in the particle dispenser 10 of FIG. 1 to dispense particles such as, for example, toner particles. The particle dispenser cartridge 400 includes an axial 401, an inboard end 405 and a dispenser cartridge outer surface 410. The dispenser cartridge 400 includes a protruding dispenser nozzle 500 with a dispenser nozzle outer surface 510. The outer surface 510 has a leading side or edge 511, a trailing side or edge 512, an inboard side or edge 515 and an outboard side or edge 519. The dispenser nozzle outer surface 510 includes one or more sealing ribs 520.

As shown in FIG. 7, the one or more sealing ribs 520 have a leading side or edge 521, a trailing side or edge 522, an inboard side or edge 525 and an outboard side or edge 529. The one or more sealing ribs 520 surround a cartridge nozzle opening 420. The nozzle opening 420 has a leading side or edge 421, a trailing side or edge 422, an inboard side or edge 425 and an outboard side or edge 429. The dispenser cartridge 400 includes a set of dispenser nozzle outer shutter rails 700 disposed on the dispenser nozzle outer surface 510. The dispenser nozzle 500 is arranged to engage a shutter 600.

FIG. 7 includes two orthogonal reference lines 92 and 93. Reference line 92 is parallel to the cartridge axial 401 and intersects the included dispenser nozzle outlet conduit 414. Reference line 92 also is depicted in FIGS. 8, 9, 11, 13 and 15, as described below. Reference line 93 is orthogonal to the cartridge axial 401, parallel to the cartridge inboard end 405 and intersects the cartridge cylindrical-shaped housing 409. Reference line 93 also is depicted in FIGS. 9-15, described below.

Figure 1:
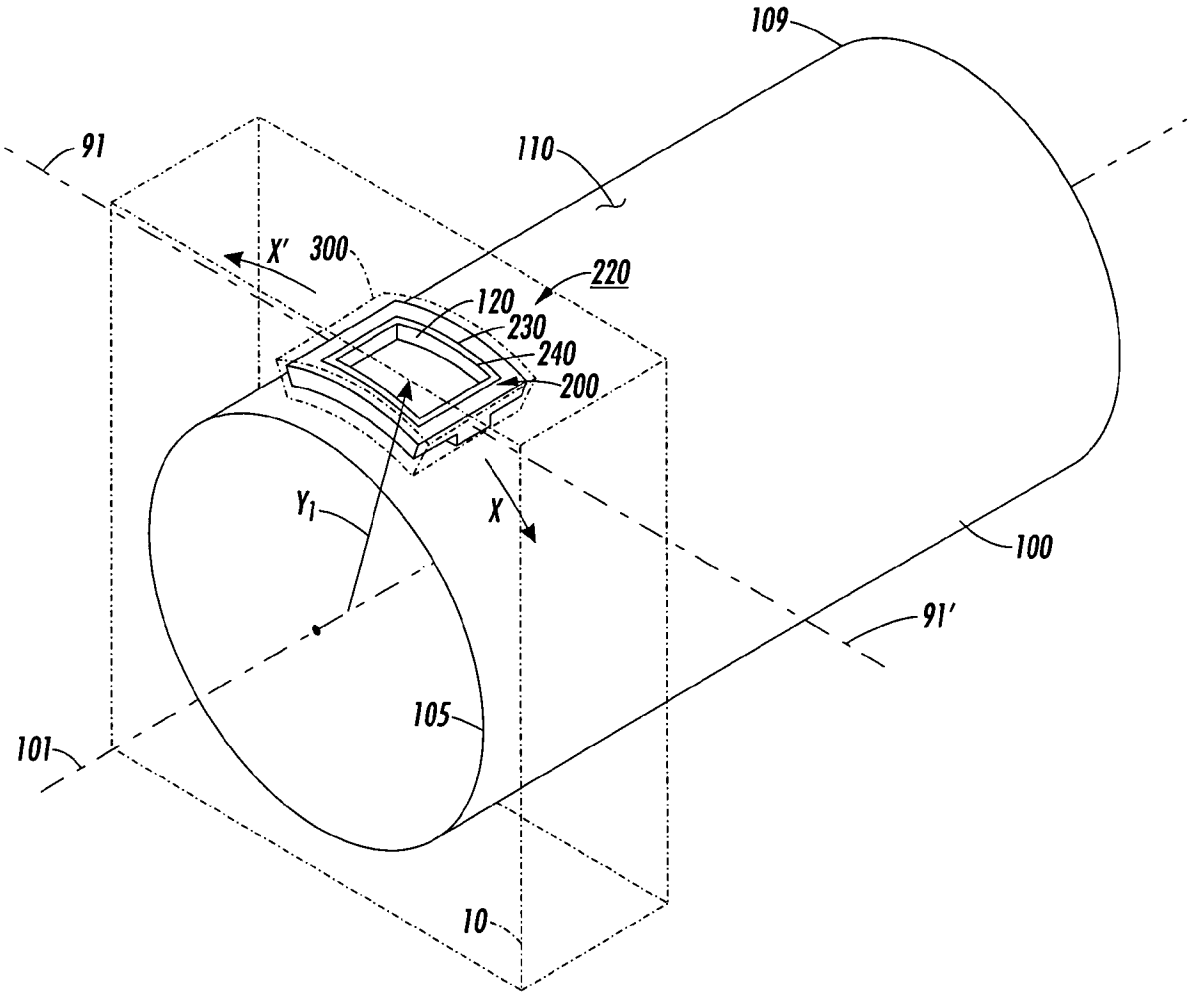
FIG. 1 PRIOR ART
FIGS. 1-2 are detached elevated perspective views of an existing cylindrical-shaped particle dispenser cartridge 100 installed in a particle dispenser 10. The particle dispenser cartridge 100 includes an axial 101, an inboard end 105, an outboard end 109 and an outer surface 110. The dispenser cartridge 100 has a protruding dispenser nozzle 200 with a dispenser nozzle outer surface 210. For good understanding, the reference number 210 is shown in FIG. 2. The dispenser nozzle outer surface 210 includes one or more sealing ribs 220. As shown, the one or more sealing ribs 220, in turn, include an outer sealing rib 230 and an inner sealing rib 240. Further, the one or more sealing ribs 220 surround a cartridge nozzle opening 120. The dispenser nozzle 200 is arranged to engage a shutter 300. The shutter 300, in turn, includes an outer surface 310.
Figure 2:
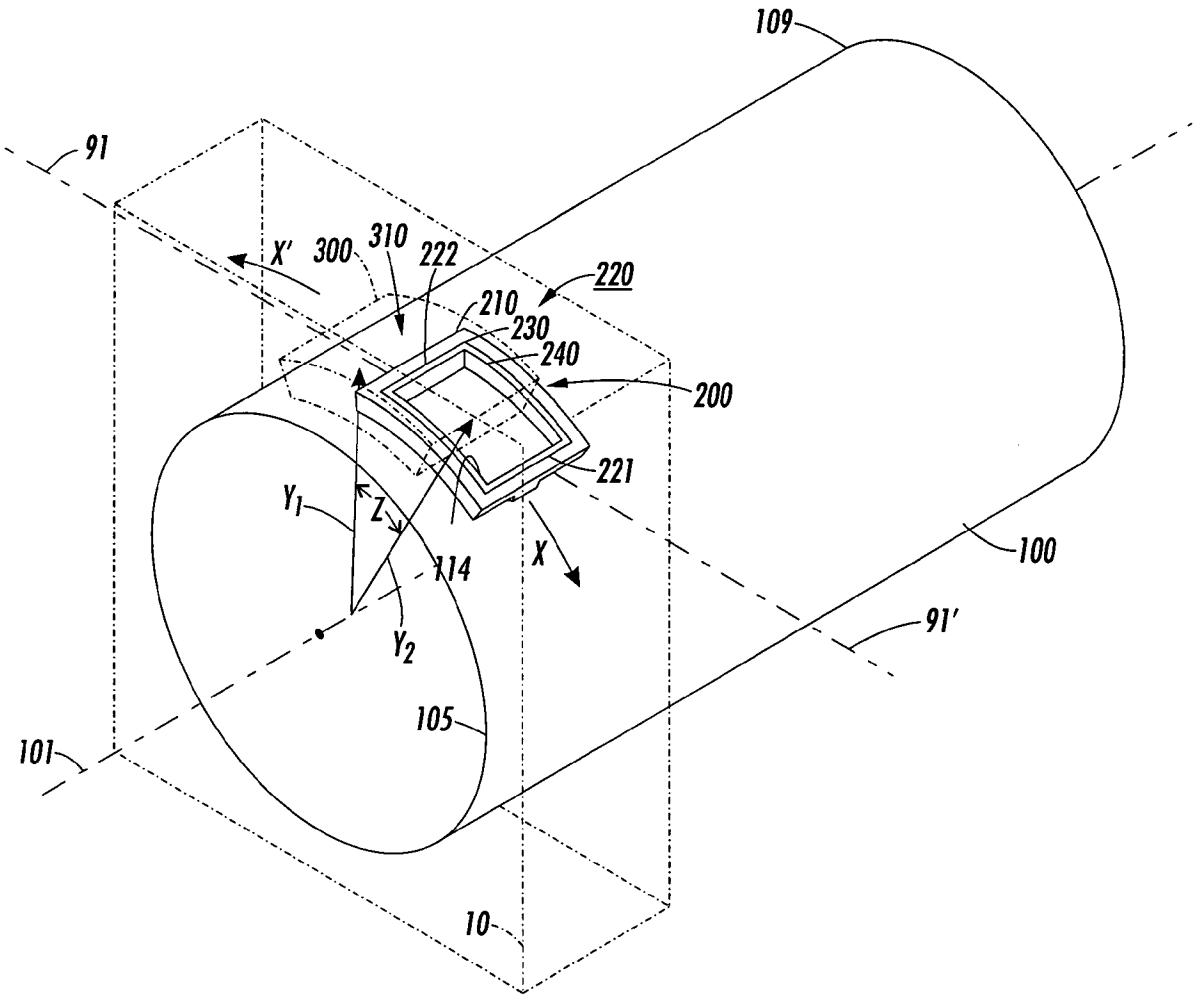
FIG. 2 PRIOR ART
Figure 3:
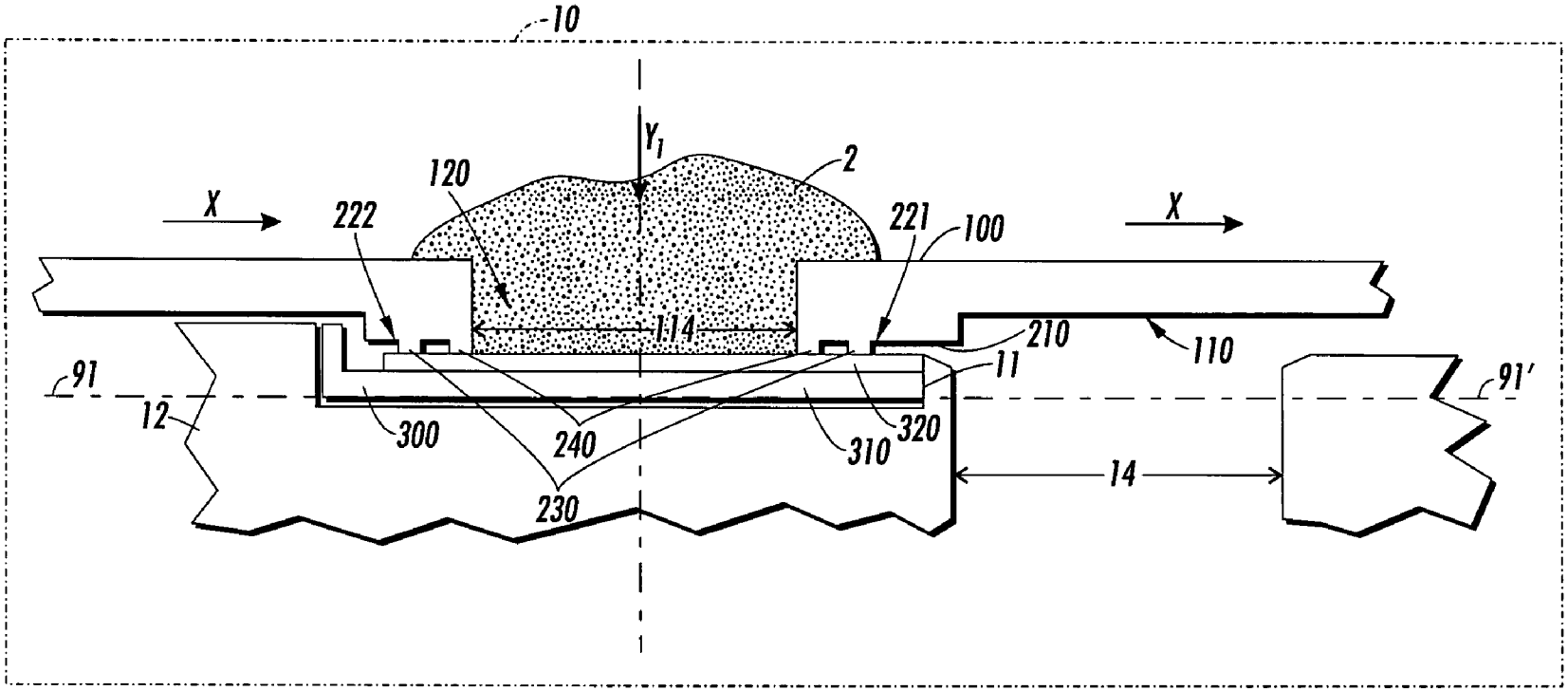
FIG. 3 PRIOR ART
FIGS. 3-6 are cutaway profile views of the existing dispenser cartridge 100 and the particle dispenser 10 along the reference line 91.
Figure 4:
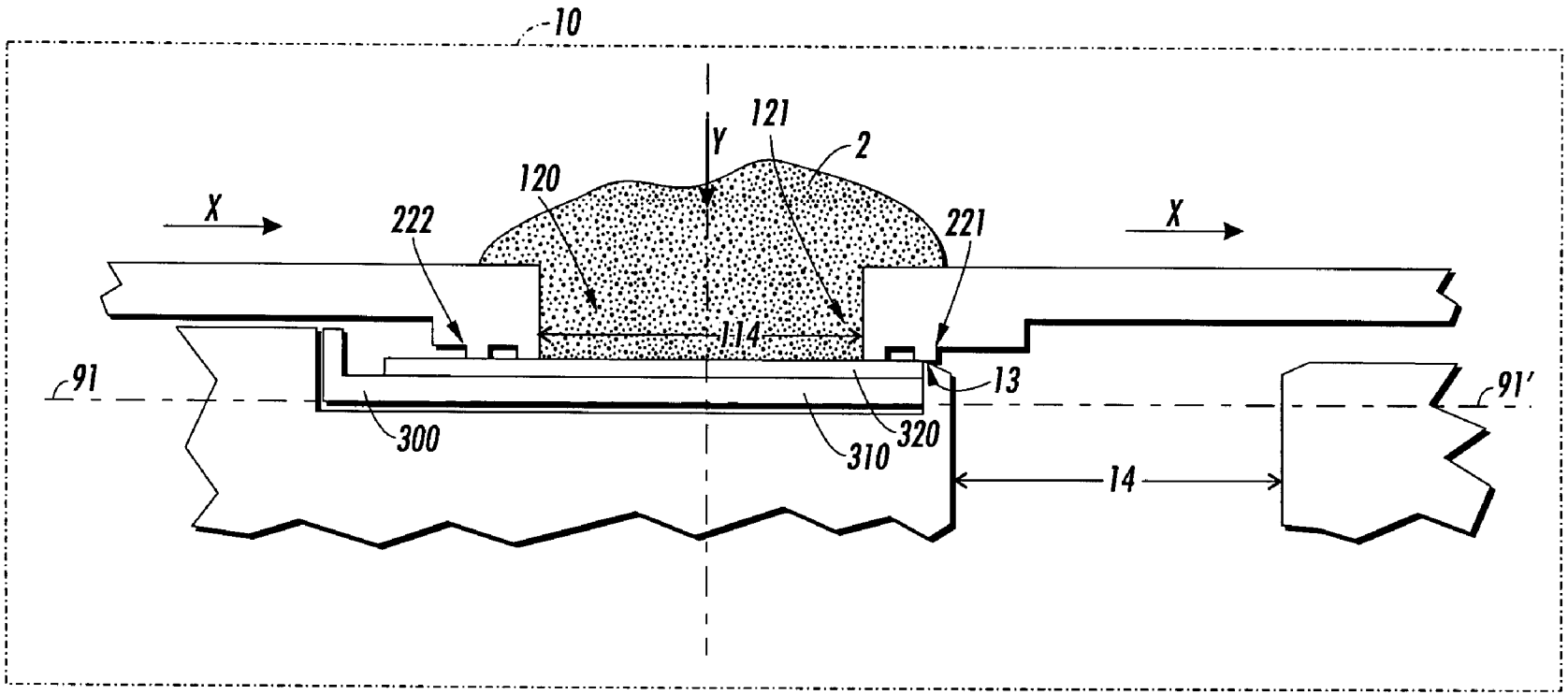
FIG. 4 PRIOR ART
Figure 5:
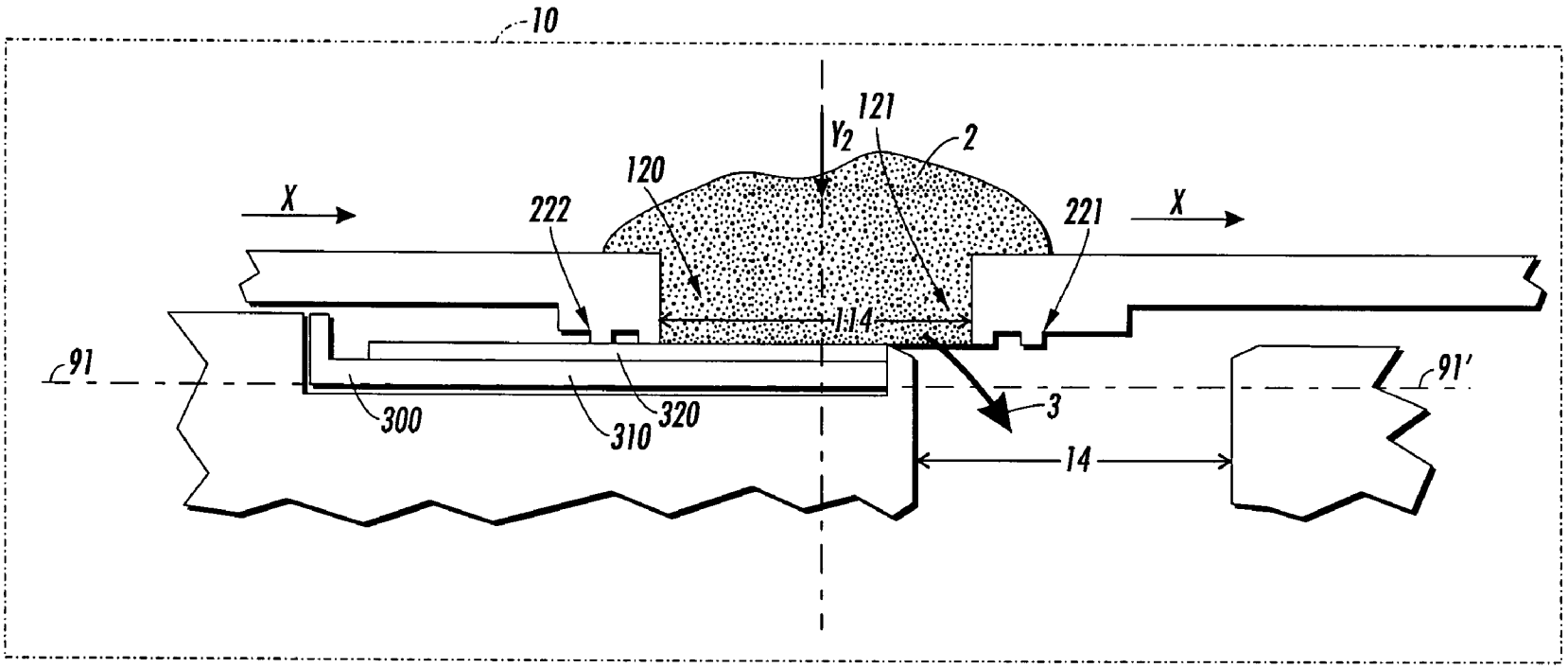
FIG. 5 PRIOR ART
Figure 6:
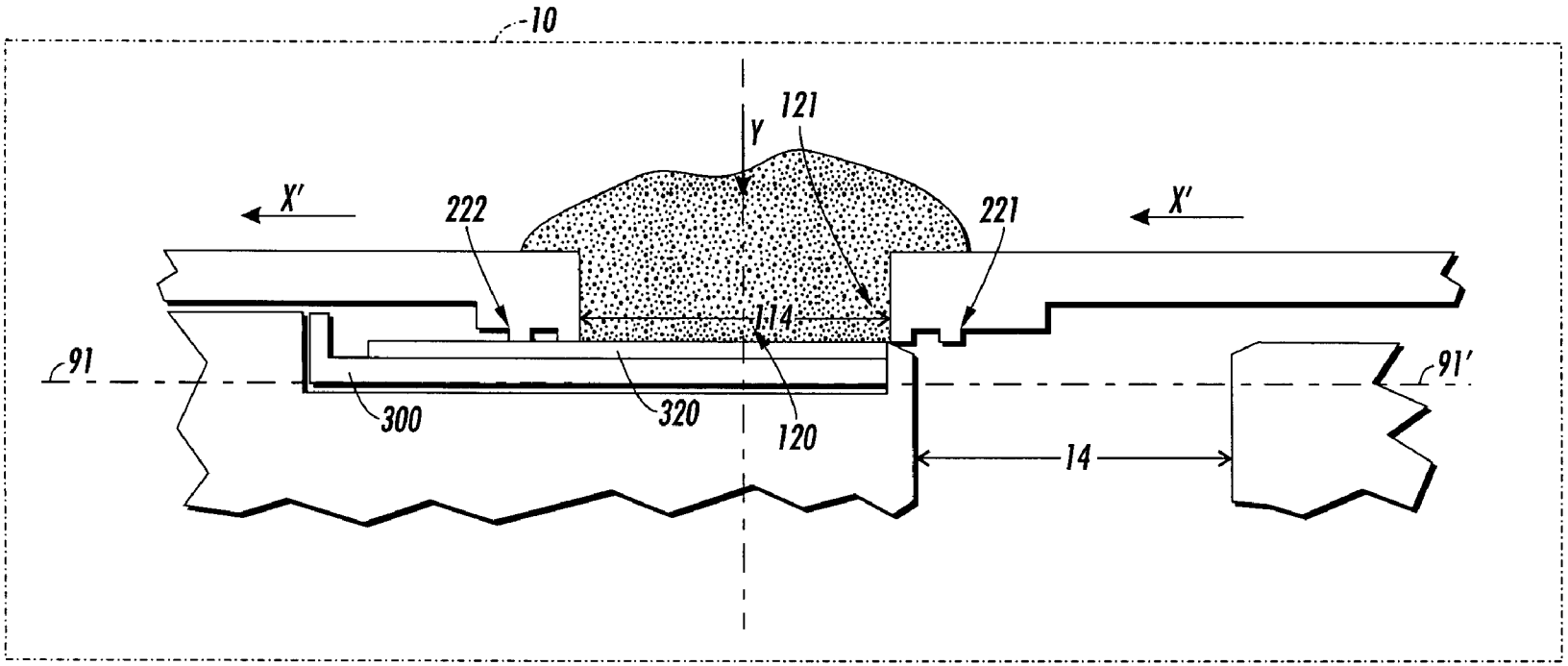
FIG. 6 PRIOR ART
Figure 7:
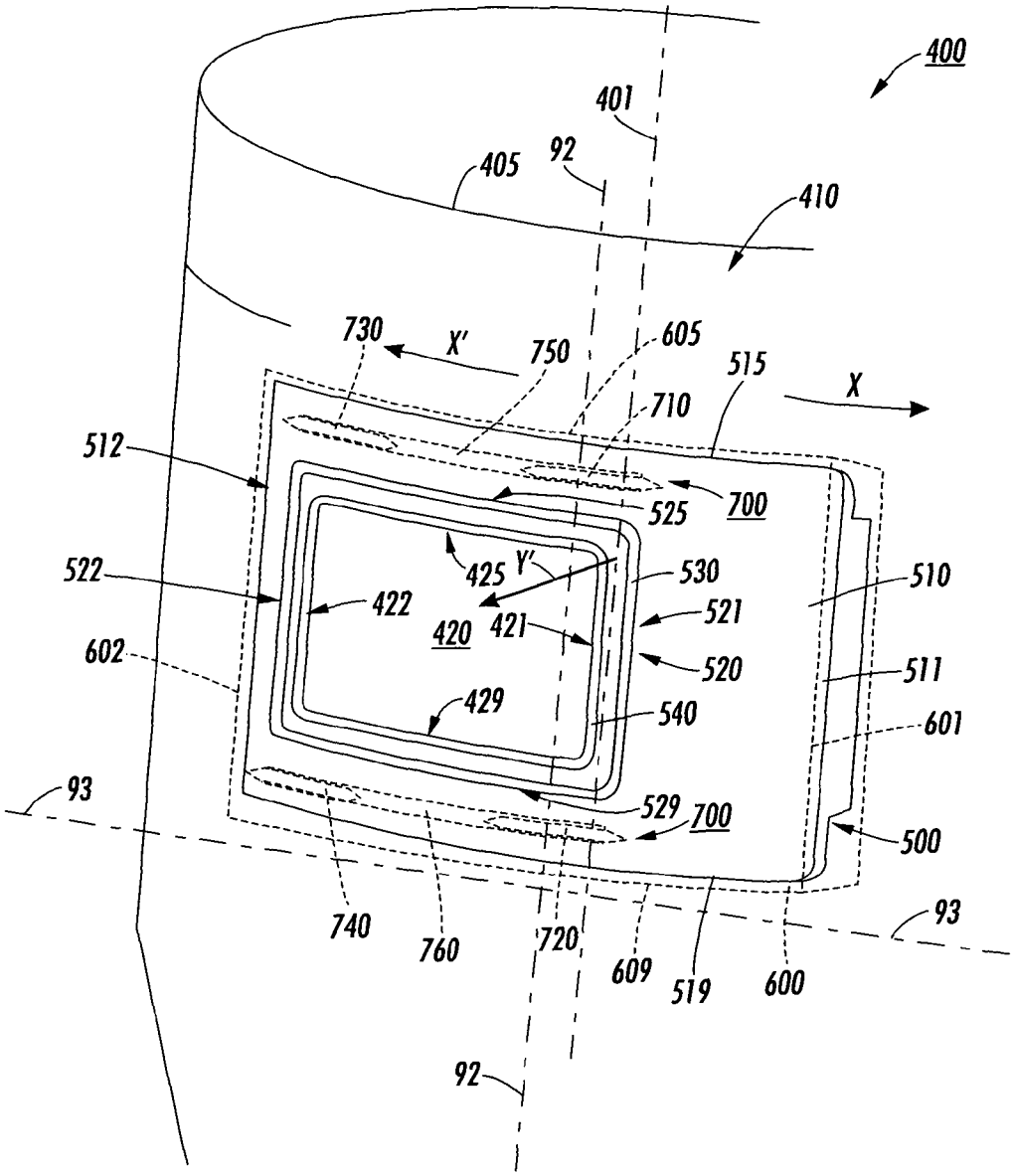
FIG. 7 is a detached elevated top-down "birds-eye" view of a particle dispenser cartridge 400 arranged with dispenser nozzle outer shutter rails 700, in accordance with the present invention.

As shown in FIG. 7, as well as in FIGS. 8, 10, 12, 14 and 15 described below, there is included an radial arrow labeled "Y'" that originates at and is orthogonal to the axial 401, and extends through the center of the nozzle opening 420.

Figure 8:
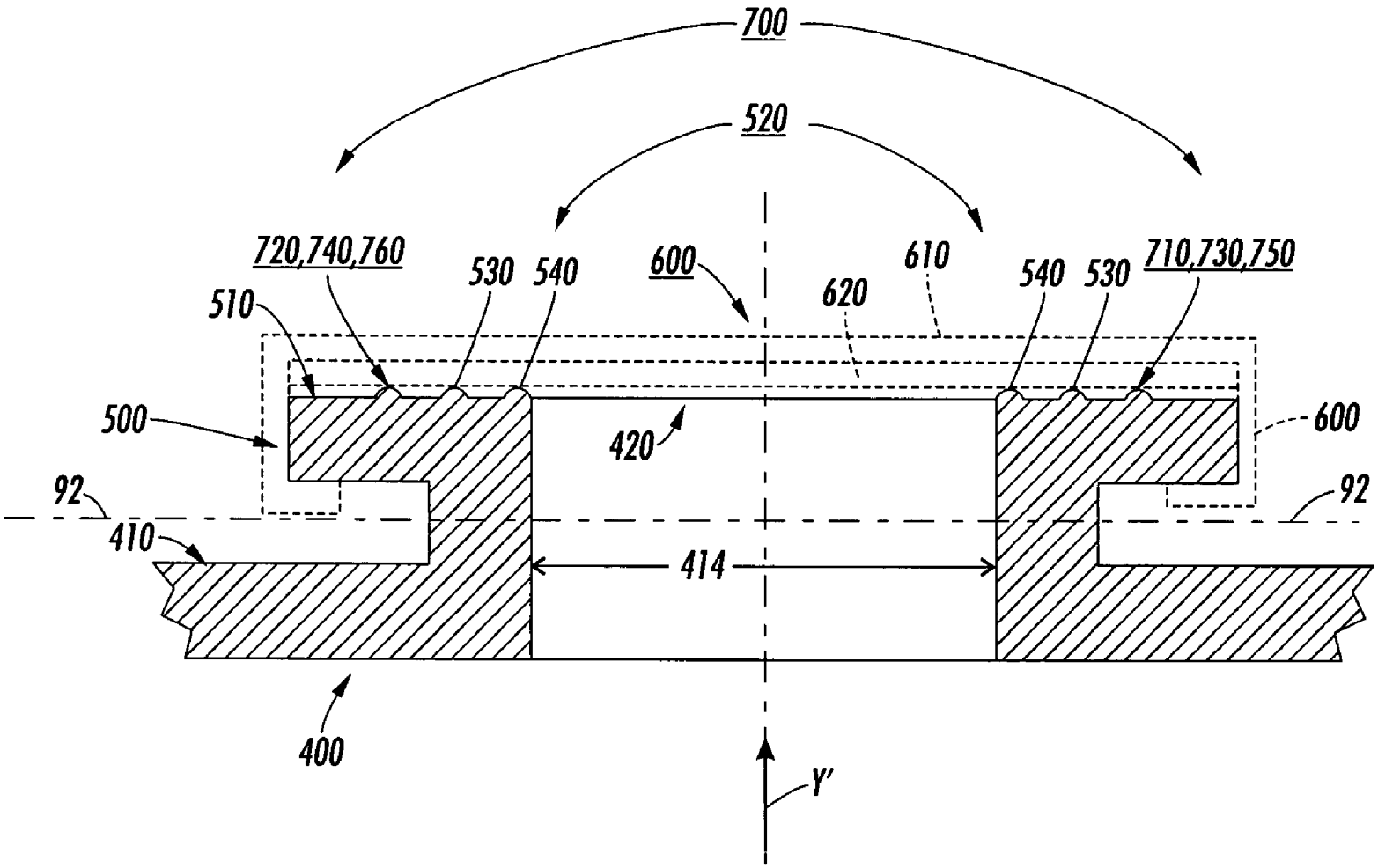

FIG. 8 is a cutaway profile view of the particle dispenser cartridge 400 of FIG. 7 along the reference line 92.

Figure 9:
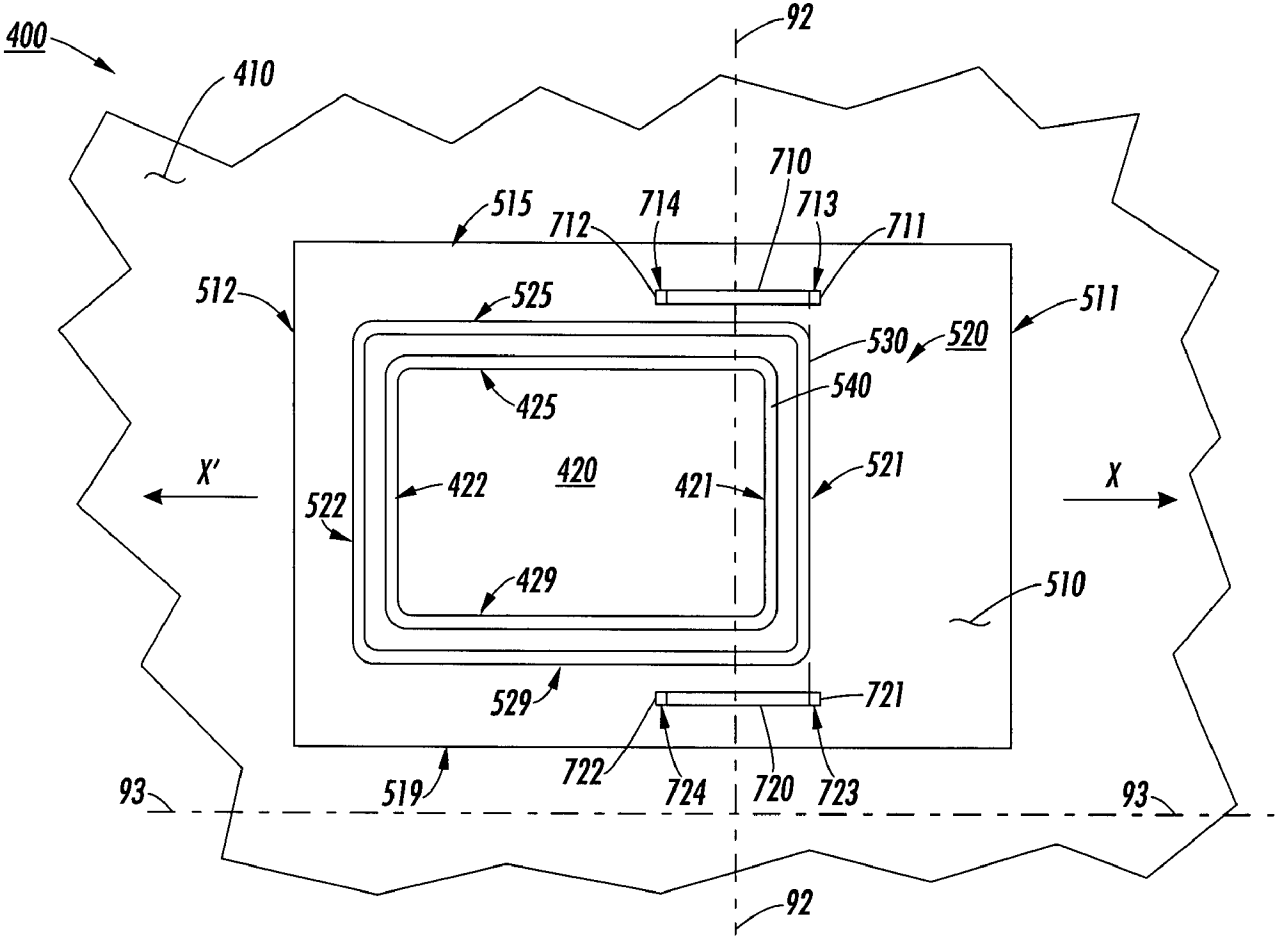

FIG. 9 is a detached elevated top-down "birds-eye" view of a first embodiment of a particle dispenser cartridge 400 arranged with dispenser nozzle outer shutter rails 700, in accordance with the present invention. As shown, the reference line 92 intersects the included two dispenser nozzle outer shutter rails 710 and 720.

Figure 10:
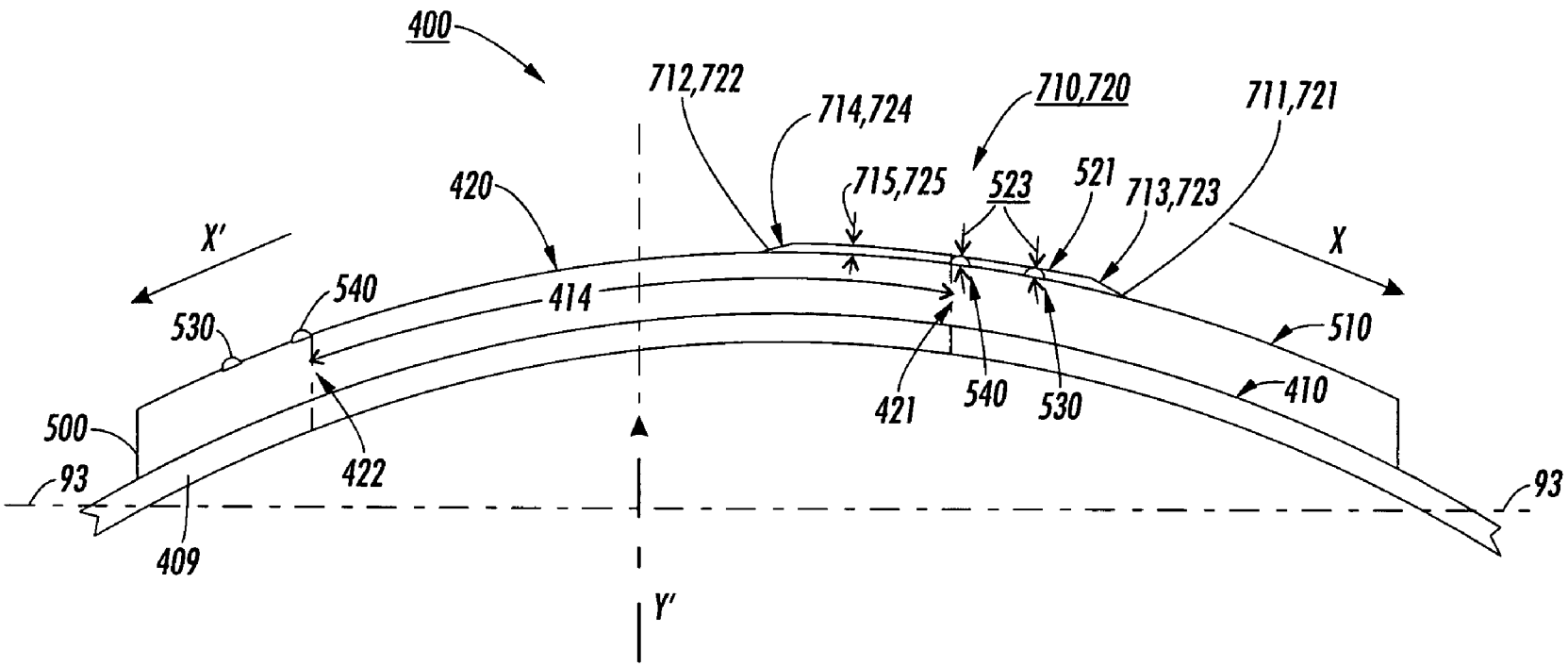

FIG. 10 is a cutaway profile view of the particle dispenser cartridge 400 of FIG. 9 along the reference line 93. As shown, the reference line 93 intersects the dispenser cartridge cylindrical-shaped housing 409.

Figure 11:
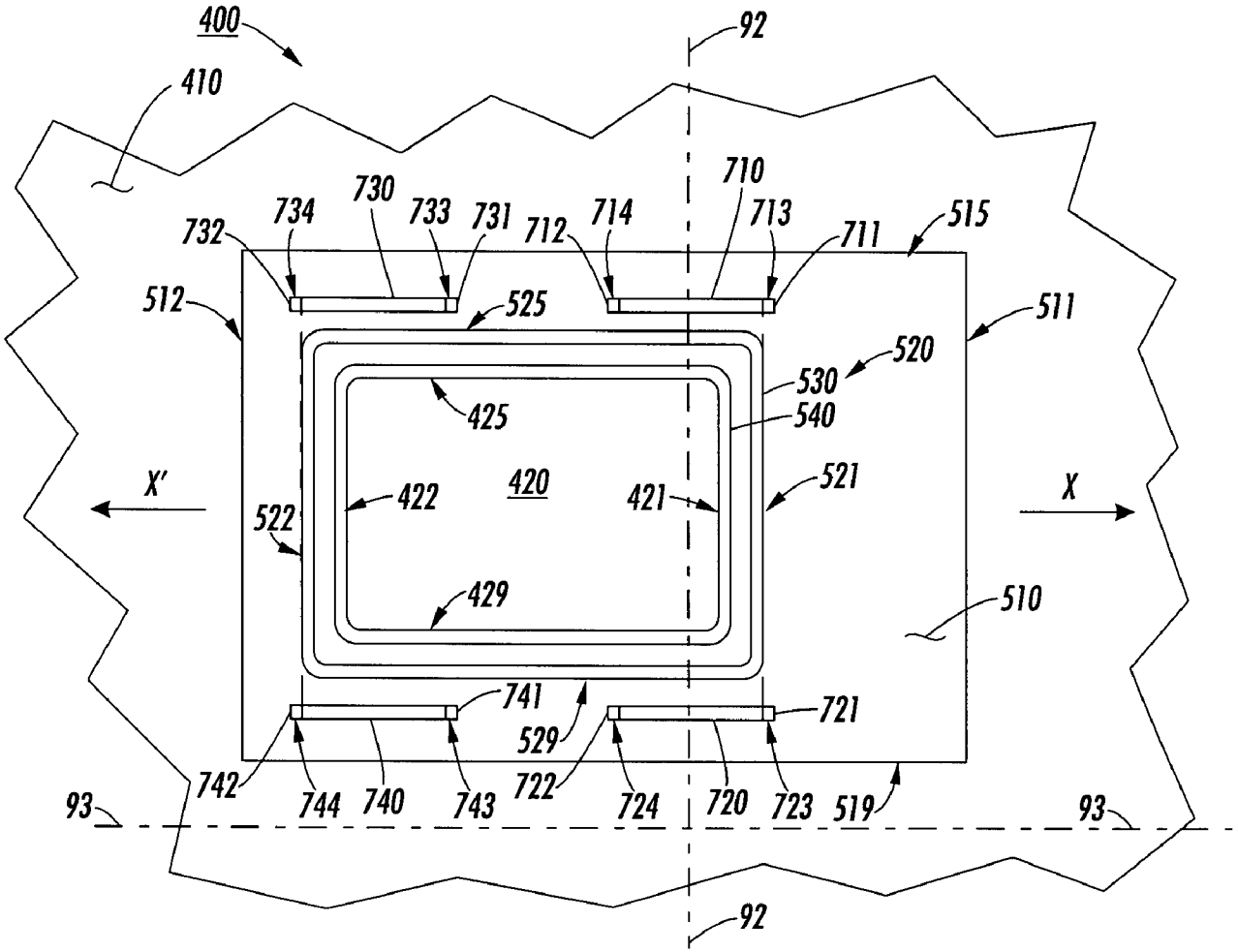

FIG. 11 is a detached elevated top-down "birds-eye" view of a second embodiment of a particle dispenser cartridge 400 arranged with dispenser nozzle outer shutter rails 700, in accordance with the present invention. As shown, there are four dispenser nozzle outer shutter rails 710, 720, 730 and 740, with the reference line 92 intersecting the two dispenser nozzle outer shutter rails 710 and 720.

Figure 12:
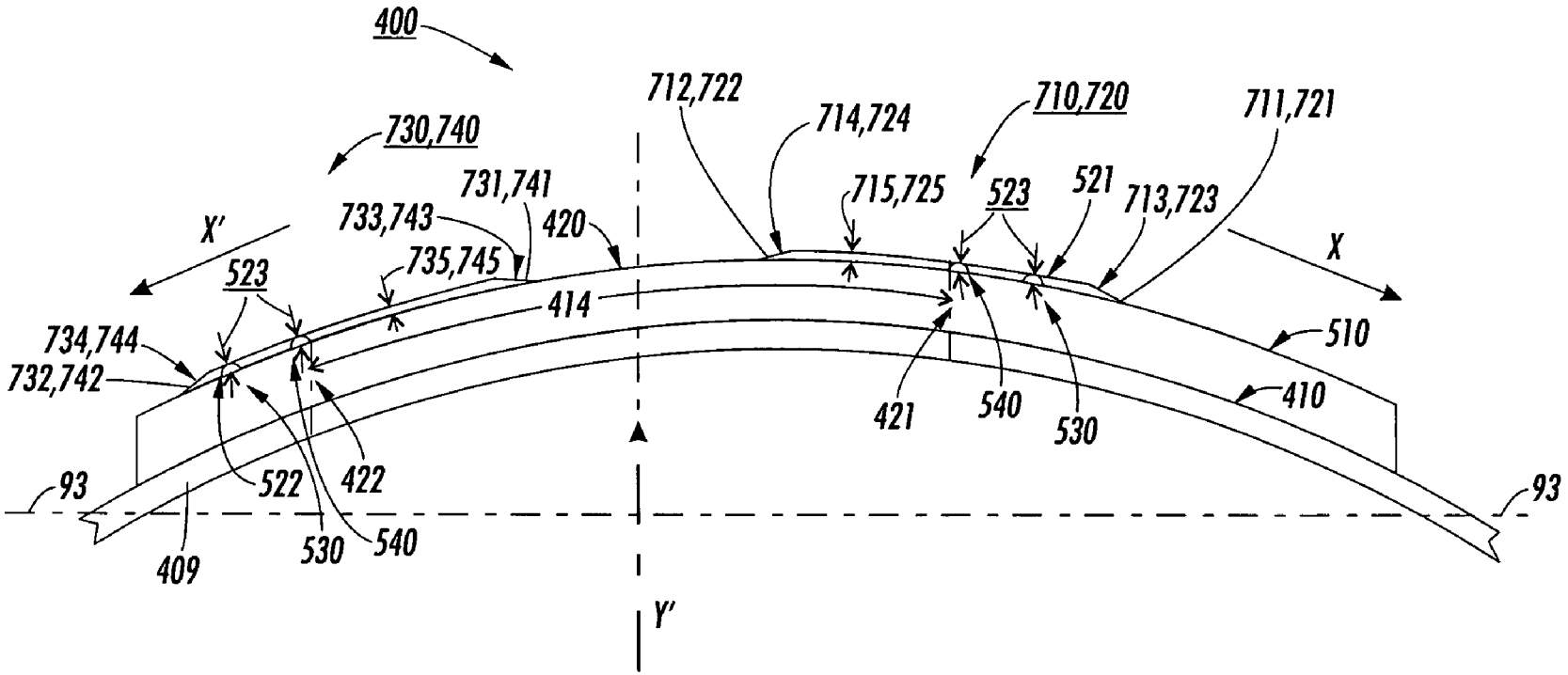

FIG. 12 is a cutaway profile view of the particle dispenser cartridge 400 of FIG. 11 along the reference line 93.

Figure 13:
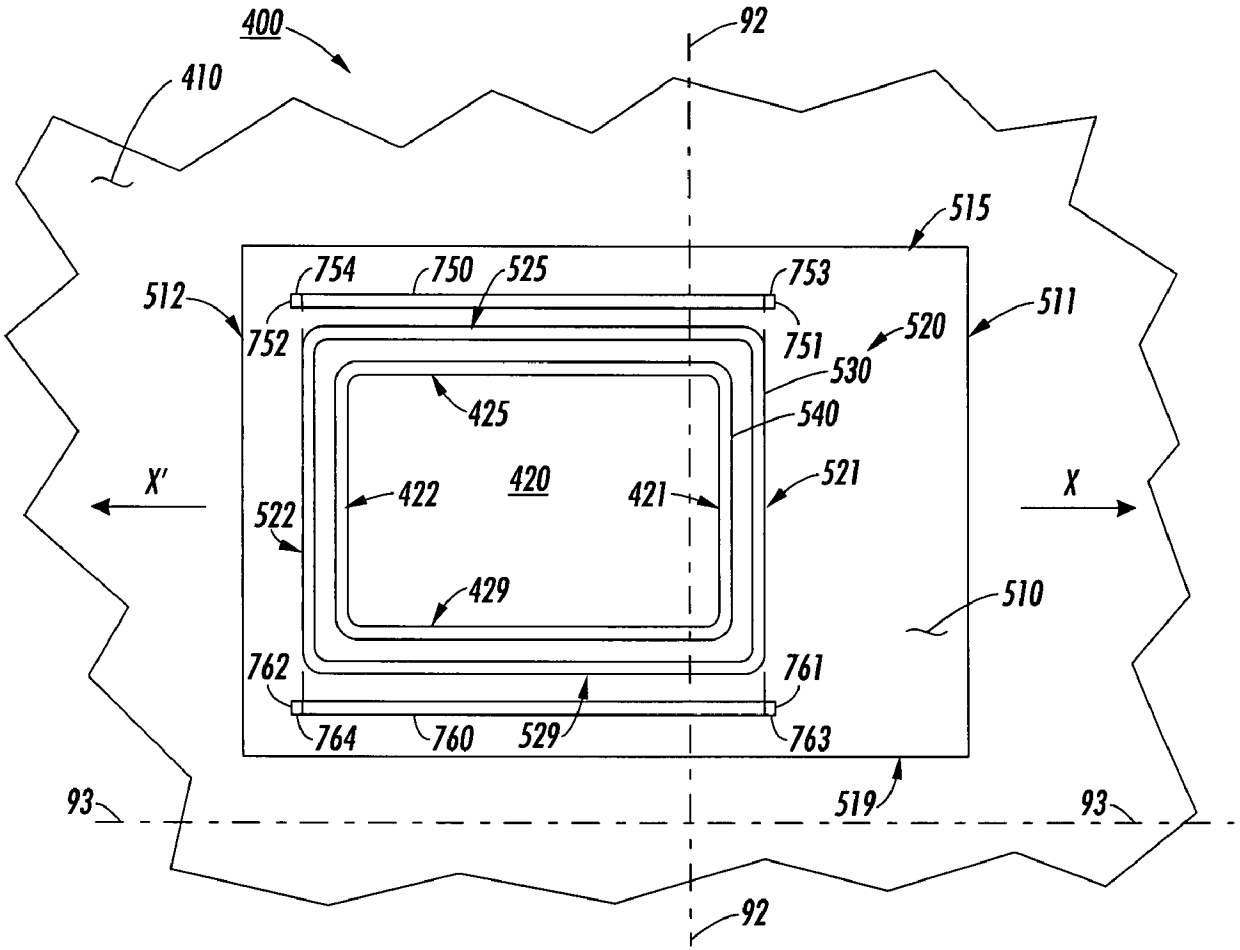

FIG. 13 is a detached elevated top-down "birds-eye" view of a third embodiment of a particle dispenser cartridge 400 arranged with dispenser nozzle outer shutter rails 700, in accordance with the present invention. As shown, the reference line 92 intersects the included two dispenser nozzle outer shutter rails 750 and 760.

Figure 14:
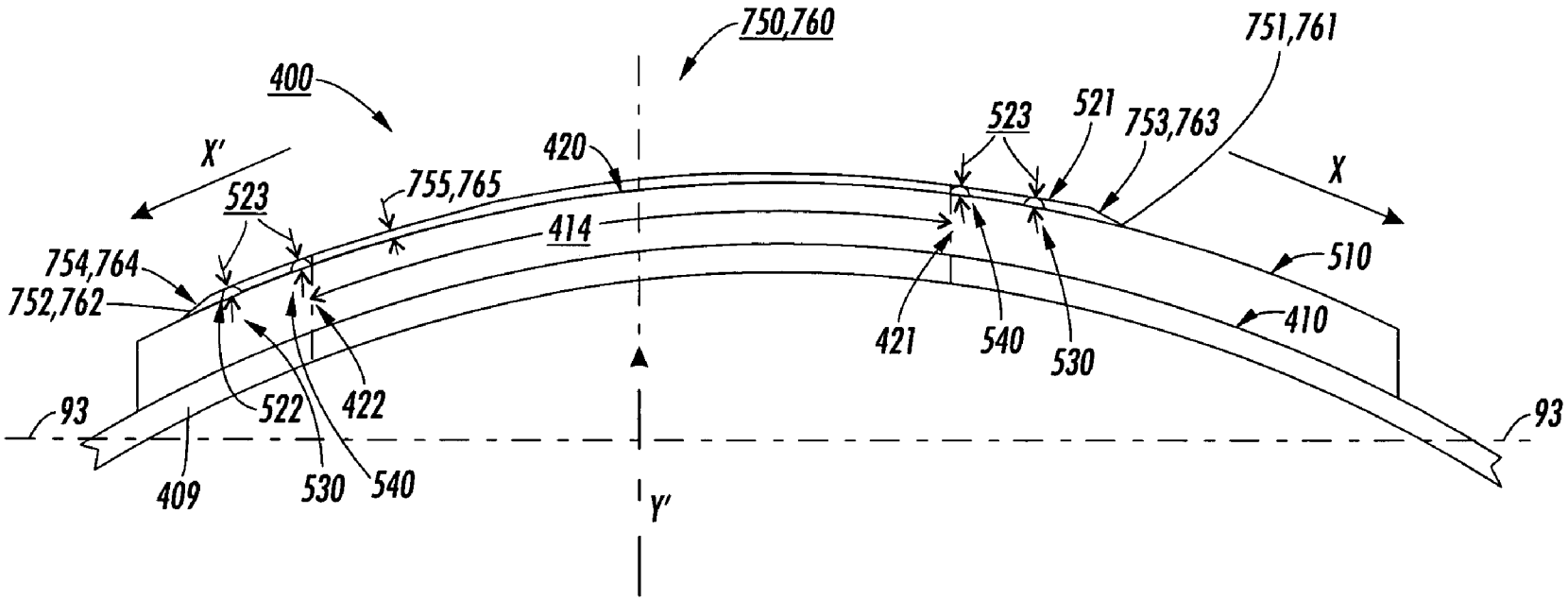

FIG. 14 is a cutaway profile view of the FIG. 13 dispenser cartridge 400 along the reference line 93.

Figure 15:
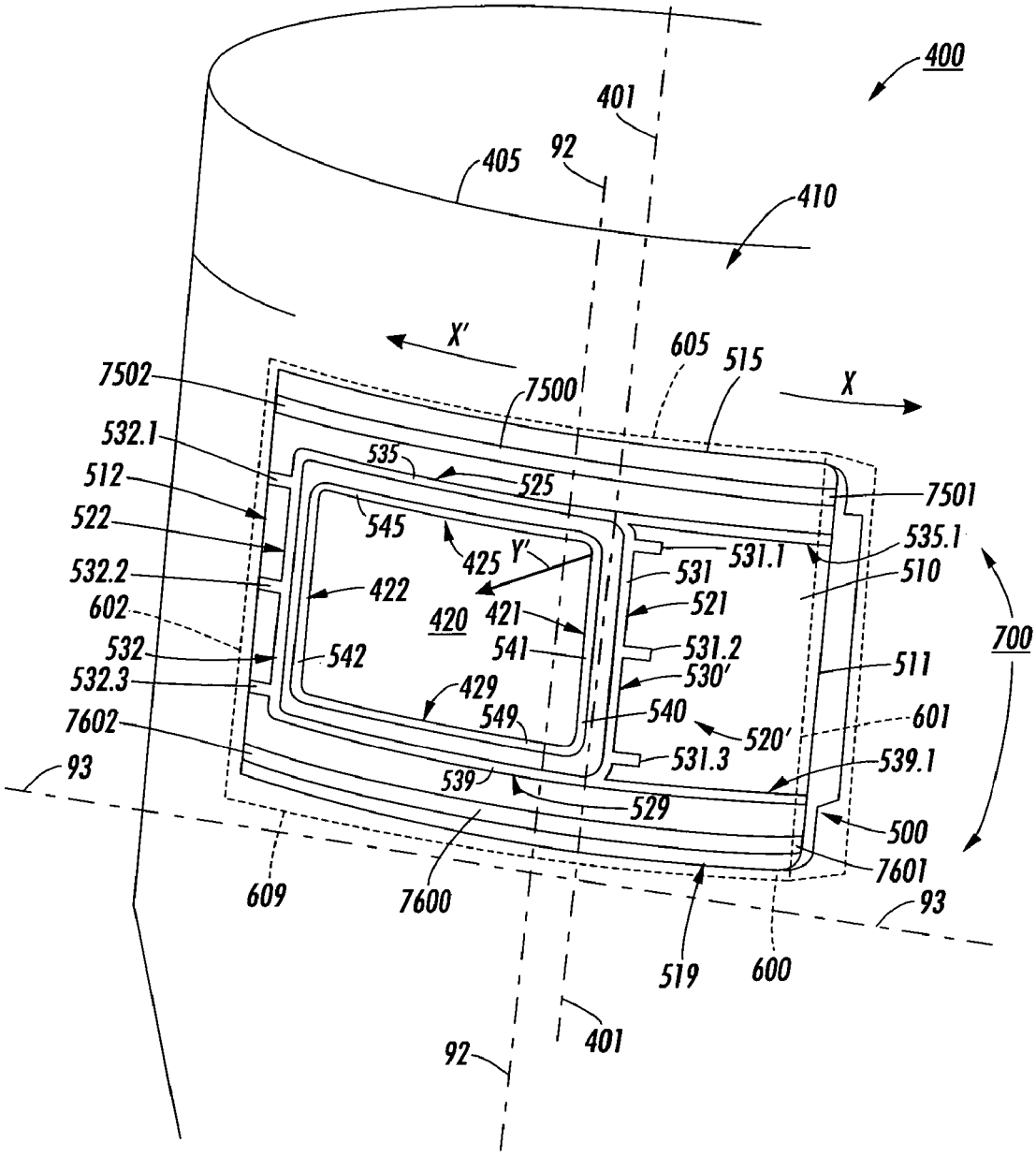

FIG. 15 is a detached elevated top-down "birds-eye" view of a fourth embodiment of a particle dispenser cartridge 400 arranged with dispenser nozzle outer shutter rails 700, in accordance with the present invention. As shown, the reference line 92 intersects the included two dispenser nozzle outer shutter rails 7500 and 7600.

DETAILED DESCRIPTION OF THE INVENTION

Briefly, a cylindrical-shaped particle dispenser cartridge includes a dispenser nozzle. The dispenser nozzle outer surface includes sealing ribs that surround an included nozzle opening. The dispenser nozzle is arranged to engage a shutter that slides over the sealing ribs, thus sealing the nozzle opening. When the cartridge rotates about the cartridge axial in a shutter-opening or leading direction (X) with respect to the shutter, the sealing ribs move in a like direction with respect to the shutter, thus unsealing the particle dispenser cartridge nozzle opening. The dispenser cartridge is arranged to dispense particles such as, for example, toner particles. In accordance with the present invention, the dispenser nozzle outer surface includes outer shutter rails disposed on inboard and outboard sides of the sealing ribs.

Referring now to FIG. 7, there is depicted a detached elevated top-down "birds-eye" view of a particle dispenser cartridge 400 arranged with dispenser nozzle outer shutter rails 700, in accordance with the present invention. The particle dispenser cartridge 400 is arranged to dispense particles including, but not limited to, toner particles.

Still referring to FIG. 7, the particle dispenser cartridge 400, similar to the dispenser cartridge 100 described in connection with FIGS. 1-6 above, includes an axial 401, an inboard end 405, an outboard end (not shown), a cartridge outer surface 410, and is arranged to contain particles 2. Moreover, similar to the dispensing described in connection with FIGS. 1-6 above, the particle dispenser cartridge 400 is arranged to be installed in the particle dispenser 10 in order to dispense the particles 2.

As shown, the dispenser cartridge 400 includes a dispenser nozzle 500 protruding from the cartridge outer surface 410.

Referring still to FIG. 7, the dispenser nozzle 500 includes a dispenser nozzle outer surface 510. The dispenser nozzle outer surface 510, in turn, includes a leading side or edge 511, a trailing side or edge 512, an inboard side or edge 515 and an outboard side or edge 519.

As shown, the dispenser nozzle outer surface 510 further includes one or more sealing ribs 520. The one or more sealing ribs 520, in turn, include a leading side or edge 521, a trailing side or edge 522, an inboard side or edge 525 and an outboard side or edge 529.

Also as shown in FIG. 7, the one or more sealing ribs 520 surround an included cartridge nozzle opening 420. The nozzle opening 420, in turn, includes a leading side or edge 421, a trailing side or edge 422, an inboard side or edge 425 and an outboard side or edge 429.

Still referring to FIG. 7, the dispenser nozzle outer surface 510 is generally rectangular-shaped with dispenser nozzle outer surface sides 511, 512, 515 and 519. Also, the particle dispenser cartridge nozzle opening 420 is generally rectangular-shaped with generally-straight sides 421, 422, 425 and 429. Further, each particle dispenser cartridge nozzle opening side 421, 422, 425 and 429 is generally parallel with its corresponding dispenser nozzle outer surface side 511, 512, 515 and 519, respectively.

As further shown in FIG. 7, each of the one or more sealing ribs 520 has four (4) generally-straight rib segments 521, 522, 525 and 529. Also, each sealing rib segment 521, 522, 525 and 529 is generally parallel with its corresponding particle dispenser cartridge nozzle opening side 421, 422, 425 and 429, respectively.

As shown in FIG. 7, in one embodiment, the one or more sealing ribs 520 comprise exactly two (2) sealing ribs, namely, the depicted outer sealing rib 530 and the inner sealing rib 540.

Referring still to FIG. 7, there are depicted two orthogonal reference lines 92 and 93. Reference line 92 is parallel to the cartridge axial 401 and intersects the included dispenser nozzle outlet conduit 414. Reference line 92 also is depicted in FIGS. 8, 9, 11, 13 and 15, described below.

Still referring to FIG. 7, reference line 93 is orthogonal to the cartridge axial 401, parallel to the cartridge inboard end 405 and intersects the cartridge cylindrical-shaped housing 409. Reference line 93 also is depicted in FIGS. 9-15, described below.

As further shown in FIG. 7, as well as in the FIGS. 8, 10, 12, 14 and 15, described below, there is depicted an radial arrow labeled "Y'" that originates at and is orthogonal to the axial 401, and extends through the center of the nozzle opening 420.

Referring now to FIG. 8, there is shown a cutaway profile view of the dispenser cartridge 400 of FIG. 7 along the reference line 92.

Referring now generally to FIGS. 7-8, as depicted therein, the dispenser nozzle 500 is arranged to engage a shutter 600, the shutter having an inner shutter sealing surface 620 and arranged to slide over the one or more sealing ribs 520, thus sealing the particle dispenser cartridge nozzle opening 420.

Still referring to FIGS. 7-8, it will be understood that the dispenser cartridge 400 depicted therein is similar in certain respects to the dispenser cartridge 100 described in connection with FIGS. 1-6 above, inasmuch as the depicted dispenser nozzle 500 is arranged so that, with the shutter 600 stationary with respect to the cartridge axial 401, when the particle dispenser cartridge 400 rotates about the particle dispenser cartridge axial 401 in the shutter-opening or leading direction (X) with respect to the shutter 600, the one or more sealing ribs 520 slide or move in a like direction with respect to the shutter sealing surface 620, thus unsealing the particle dispenser cartridge nozzle opening 420. With momentary cross-reference back to FIGS. 1-6, it will be understood that, with the nozzle opening 420 unsealed, the included particles 2 thereby flow from the included particle dispenser cartridge nozzle outlet conduit 414 and into the dispenser 10.

Still referring to FIGS. 7-8, it will be further understood that, with the shutter 600 stationary with respect to the cartridge axial 401, when the cartridge 400 rotates in the opposite shutter-closing or trailing direction (X') with respect to the shutter 600, the one or more sealing ribs 520 slide or move in a like direction with respect to the shutter sealing surface 620, thereby sealing the nozzle opening 420. As a result, the flow of particles 2 from the particle dispenser cartridge nozzle outlet conduit 414 now ceases.

In contrast to the dispenser cartridge 100 described in connection with FIGS. 1-6 above, however, in accordance with the present invention, as depicted in the present FIGS. 7-8, and as further depicted in FIG. 15 below, the dispenser cartridge 400 further includes a set of dispenser nozzle outer shutter rails 700 disposed on the dispenser nozzle outer surface 510.

Moreover, as depicted in FIGS. 7-8, and as described in connection with FIGS. 9-15 below, there are at least four (4) separate embodiments of a particle dispenser cartridge 400 arranged with dispenser nozzle outer shutter rails 700, in accordance with the present invention.

Referring now to FIG. 9, there is shown a detached elevated top-down "birds-eye" view of a first embodiment of a particle dispenser cartridge 400 arranged with dispenser nozzle outer shutter rails 700, in accordance with the present invention.

With momentary cross-reference back to FIGS. 7-8, as depicted therein, and as previously described in connection with the same FIGS. 7-8 above, it will be recalled that the dispenser cartridge 400 includes the dispenser nozzle 500. With continued momentary cross-reference to FIGS. 7-8, it will further be recalled that the dispenser nozzle 500, in turn, includes the dispenser nozzle outer surface 510.

Again referring to the present FIG. 9 depicting the first embodiment of the particle dispenser cartridge 400 arranged with dispenser nozzle outer shutter rails 700, in accordance with the present invention, as depicted therein, the dispenser nozzle outer surface 510 includes a first dispenser nozzle outer shutter rail 710 disposed on an inboard side 525 of the one or more sealing ribs 520 and a second dispenser nozzle outer shutter rail 720 disposed on the opposite outboard side 529 of the one or more sealing ribs 520. Each of the first and second dispenser nozzle outer shutter rails 710 and 720 include corresponding leading rail ends 711 and 721, opposite trailing rail ends 712 and 722, with corresponding shutter rail lengths therebetween. The leading rail ends 711 and 721 extend beyond the leading edge 521 of the one or more sealing ribs 520 in the shutter-opening or leading direction (X). Also, the trailing rail ends 712 and 722 extend beyond the leading edge 421 of the particle dispenser cartridge nozzle opening 420 in the opposite shutter-closing or trailing direction (X').

Still referring to FIG. 9, as depicted therein, the reference line 92 intersects the two dispenser nozzle outer shutter rails 710 and 720.

As shown in FIG. 9, in one embodiment, the first and second dispenser nozzle outer shutter rails 710 and 720 are generally parallel to each other.

Still referring to FIG. 9, in one embodiment, the first dispenser nozzle outer shutter rail 710 is parallel to the inboard side or edge 525 of the one or more sealing ribs 520 and the second dispenser nozzle outer shutter rail 720 is parallel to the outboard side or edge 529 of the one or more sealing ribs 520.

Referring still to FIG. 9, in one embodiment, the spacing between the first dispenser nozzle outer shutter rail 710 and the inboard side or edge 525 of the one or more sealing ribs 520 is equal to the spacing between the second dispenser nozzle outer shutter rail 720 and the outboard side or edge 529 of the one or more sealing ribs 520.

Referring now to FIG. 10, there is shown a cutaway profile view of the FIG. 9 dispenser cartridge 400 along the reference line 93.

As shown in FIG. 10, each leading rail end 711 and 721 of the corresponding first and second dispenser nozzle outer shutter rails 710 and 720 is shaped to form a corresponding leading inclined ramp 713 and 723 with respect to the dispenser nozzle outer surface 510.

Also as shown in FIG. 10, each trailing rail end 712 and 722 of the corresponding first and second dispenser nozzle outer shutter rails 710 and 720 is shaped to form a corresponding trailing inclined ramp 714 and 724 with respect to the dispenser nozzle outer surface 510.

As shown in FIGS. 9-10, each leading rail end 711 and 721 of the corresponding first and second dispenser nozzle outer shutter rails 710 and 720 extends an equal distance beyond the leading edge 521 of the one or more sealing ribs 520.

Also as shown in FIGS. 9-10, the first and second dispenser nozzle outer shutter rails 710 and 720 have generally identical corresponding shapes and dimensions and further have a common dispenser nozzle outer shutter rail height 715 and 725 that at least equals the corresponding height 523 of the one or more sealing ribs 520 with respect to the dispenser nozzle outer surface 510.

Also as shown in FIGS. 9-10, the whole leading inclined ramp portion 713 and 723 of each of the corresponding first and second dispenser nozzle outer shutter rails 710 and 720 extends beyond the leading edge 521 of the one or more sealing ribs 520.

Referring now to FIG. 11, there is shown a detached elevated top-down "birds-eye" view of a second embodiment of a particle dispenser cartridge 400 arranged with dispenser nozzle outer shutter rails 700, in accordance with the present invention.

With momentary cross-reference back to FIGS. 7-8, as depicted therein, and as previously described in connection with the same FIGS. 7-8 above, it will be recalled that the dispenser cartridge 400 includes the dispenser nozzle 500. With continued momentary cross-reference to FIGS. 7-8, it will further be recalled that the dispenser nozzle 500, in turn, includes the dispenser nozzle outer surface 510.

Again referring to the present FIG. 11 depicting the second embodiment of the particle dispenser cartridge 400 arranged with dispenser nozzle outer shutter rails 700, in accordance with the present invention, as depicted therein, the dispenser nozzle outer surface 510 includes four individual dispenser nozzle outer shutter rails 710, 720, 730, 740 disposed thereon. A first dispenser nozzle outer shutter rail 710 and a third dispenser nozzle outer shutter rail 730 are disposed on the inboard side 525 of the one or more sealing ribs 520. Also, a second dispenser nozzle outer shutter rail 720 and a fourth dispenser nozzle outer shutter rail 740 are disposed on the opposite outboard side 529 of the one or more sealing ribs 520.

Still referring to FIG. 11, each of the first and second dispenser nozzle outer shutter rails 710 and 720 include corresponding leading rail ends 711 and 721, opposite trailing rail ends 712 and 722, with corresponding shutter rail lengths therebetween. The leading rail ends 711 and 721 extend beyond the leading edge 521 of the one or more sealing ribs 520 in the shutter-opening or leading direction (X). Also, the trailing rail ends 712 and 722 extend beyond the leading edge 421 of the particle dispenser cartridge nozzle opening 520 in the opposite shutter-closing or trailing direction (X').

Referring still to FIG. 11, each of the third and fourth dispenser nozzle outer shutter rails 730 and 740 include corresponding leading rail ends 731 and 741, opposite trailing rail ends 732 and 742, with corresponding shutter rail lengths therebetween. The leading rail ends 731 and 741 extend beyond the trailing edge 422 of the particle dispenser cartridge nozzle opening 420 in the shutter-opening or leading direction (X). Also, the trailing rail ends 732 and 742 extend beyond the trailing edge 522 of the one or more sealing ribs 520 in the opposite shutter-closing or trailing direction (X').

Still referring to FIG. 11, as depicted therein, the reference line 92 intersects the two dispenser nozzle outer shutter rails 710 and 720.

As shown in FIG. 11, in one embodiment, the first and second dispenser nozzle outer shutter rails 710 and 720 are generally parallel to each other, and the third and fourth dispenser nozzle outer shutter rails 730 and 740 are generally parallel to each other.

Still referring to FIG. 11, in one embodiment, the first and third dispenser nozzle outer shutter rails 710 and 730 are parallel to the inboard side or edge 525 of the one or more sealing ribs 520 and the second and fourth dispenser nozzle outer shutter rails 720 and 740 are parallel to the outboard side or edge 529 of the one or more sealing ribs 520.

Referring still to FIG. 11, in one embodiment, the spacing between the first dispenser nozzle outer shutter rail 710 and the inboard side or edge 525 of the one or more sealing ribs 520 is equal to the spacing between the second dispenser nozzle outer shutter rail 720 and the outboard side or edge 529 of the one or more sealing ribs 520.

Still referring to FIG. 11, in one embodiment, the spacing between the third dispenser nozzle outer shutter rail 730 and the inboard side or edge 525 of the one or more sealing ribs 520 is equal to the spacing between the fourth dispenser nozzle outer shutter rail 740 and the outboard side or edge 529 of the one or more sealing ribs 520.

Referring still to FIG. 11, in one embodiment, the spacing between the first dispenser nozzle outer shutter rail 710 and the inboard side or edge 525 of the one or more sealing ribs 520 is equal to the spacing between the third dispenser nozzle outer shutter rail 730 and the inboard side or edge 525 of the one or more sealing ribs 520.

Still referring to FIG. 11, in one embodiment, the spacing between the second dispenser nozzle outer shutter rail 720 and the outboard side or edge 529 of the one or more sealing ribs 520 is equal to the spacing between the fourth dispenser nozzle outer shutter rail 740 and the outboard side or edge 529 of the one or more sealing ribs 520.

Referring now to FIG. 12, there is shown a cutaway profile view of the FIG. 11 dispenser cartridge 400 along the reference line 93 of FIG. 7.

As shown in FIG. 12, each leading rail end 711, 721, 731 and 741 of the corresponding first, second, third and fourth dispenser nozzle outer shutter rails 710, 720, 730 and 740 is shaped to form a corresponding leading inclined ramp 713, 723, 733 and 743, with respect to the dispenser nozzle outer surface 510.

Also as shown in FIG. 12, each trailing rail end 712, 722, 732 and 742 of the corresponding first, second, third and fourth dispenser nozzle outer shutter rails 710, 720, 730 and 740 is shaped to form a corresponding trailing inclined ramp 714, 724, 734 and 744, with respect to the dispenser nozzle outer surface 510.

As shown in FIGS. 11-12, each leading rail end 711 and 721 of the corresponding first and second dispenser nozzle outer shutter rails 710 and 720 extend an equal distance beyond the leading edge 521 of the one or more sealing ribs 520 and each trailing rail end 732, 742 of the corresponding third and fourth dispenser nozzle outer shutter rails 730 and 740 extend an equal distance beyond the trailing edge 522 of the one or more sealing ribs 520.

Also as shown in FIGS. 11-12, the first and second dispenser nozzle outer shutter rails 710 and 720 have generally identical corresponding shapes and dimensions; the third and fourth dispenser nozzle outer shutter rails 730 and 740 have generally identical corresponding shapes and dimensions; and the first, second, third and fourth dispenser nozzle outer shutter rails 710, 720, 730 and 740 have a common dispenser nozzle outer shutter rail height 715, 725, 735 and 745 that at least equals the corresponding height 523 of the one or more sealing ribs 520 with respect to the dispenser nozzle outer surface 510.

Also as shown in FIGS. 11-12, the whole leading inclined ramp-portion 713 and 723 of each of the corresponding first and second dispenser nozzle outer shutter rails 710 and 720 extend beyond the leading edge 521 of the one or more sealing ribs 520 and the whole trailing inclined ramp portion 734 and 744 of each of the corresponding third and fourth dispenser nozzle outer shutter rails 730 and 740 extend beyond the trailing edge 522 of the one or more sealing ribs 520.

Referring now to FIG. 13, there is shown a detached elevated top-down "birds-eye" view of a third embodiment of a particle dispenser cartridge 400 arranged with dispenser nozzle outer shutter rails 700, in accordance with the present invention.

With momentary cross-reference back to FIGS. 7-8, as depicted therein, and as previously described in connection with the same FIGS. 7-8 above, it will be recalled that the dispenser cartridge 400 includes the dispenser nozzle 500. With continued momentary cross-reference to FIGS. 7-8, it will further be recalled that the dispenser nozzle 500, in turn, includes the dispenser nozzle outer surface 510.

Again referring to the present FIG. 13 depicting the third embodiment of the particle dispenser cartridge 400 arranged with dispenser nozzle outer shutter rails 700, in accordance with the present invention, as depicted therein, the dispenser nozzle outer surface 510 includes a first dispenser nozzle outer shutter rail 750 disposed on the inboard side 525 of the one or more sealing ribs 520 and a second dispenser nozzle outer shutter rail 760 disposed on the opposite outboard side 529 of the one or more sealing ribs 520. Each of the first and second dispenser nozzle outer shutter rails 750 and 760 includes corresponding leading rail ends 751 and 761, opposite trailing rail ends 752 and 762, with corresponding shutter rail lengths therebetween. The leading rail ends 751 and 761 extend beyond the leading edge 521 of the one or more sealing ribs 520 in the shutter-opening or leading direction (X). Also, the trailing rail ends 752 and 762 extend beyond the trailing edge 522 of the one or more sealing ribs 520 in the opposite shutter-closing or trailing direction (X').

Still referring to FIG. 13, as depicted therein, the reference line 92 intersects the two dispenser nozzle outer shutter rails 750 and 760.

As shown in FIG. 13, in one embodiment, the first and second dispenser nozzle outer shutter rails 750 and 760 are generally parallel to each other.

Still referring to FIG. 13, in one embodiment, the first dispenser nozzle outer shutter rail 750 is parallel to the inboard side or edge 525 of the one or more sealing ribs 520 and the second dispenser nozzle outer shutter rail 760 is parallel to the outboard side or edge 529 of the one or more sealing ribs 520.

Referring still to FIG. 13, in one embodiment, the spacing between the first dispenser nozzle outer shutter rail 750 and the inboard side or edge 525 of the one or more sealing ribs 520 is equal to the spacing between the second dispenser nozzle outer shutter rail 760 and the outboard side or edge 529 of the one or more sealing ribs 520.

Referring now to FIG. 14, there is shown a cutaway profile view of the FIG. 13 dispenser cartridge 400 along the reference line 93.

As shown in FIG. 14, each leading rail end 751 and 761 of the corresponding first and second dispenser nozzle outer shutter rails 750 and 760 is shaped to form a corresponding leading inclined ramp 753 and 763 with respect to the dispenser nozzle outer surface 510.

Also as shown in FIG. 14, each trailing rail end 752 and 762 of the corresponding first and second dispenser nozzle outer shutter rails 750 and 760 is shaped to form a corresponding trailing inclined ramp 754 and 764 with respect to the dispenser nozzle outer surface 510.

As shown in FIGS. 13-14, each leading rail end 751 and 761 of the corresponding first and second dispenser nozzle outer shutter rails 750 and 760 extends an equal distance beyond the leading edge 521 of the one or more sealing ribs 520 and each trailing rail end 752 and 762 of the corresponding first and second dispenser nozzle outer shutter rails 750 and 760 extends an equal distance beyond the trailing edge 522 of the one or more sealing ribs 520.

Also as shown in FIGS. 13-14, the first and second dispenser nozzle outer shutter rails 750 and 760 have generally identical corresponding shapes and dimensions and further have a common dispenser nozzle outer shutter rail height 755 and 765 that at least equals the corresponding height 523 of the one or more sealing ribs 520 with respect to the dispenser nozzle outer surface 510.

Also as shown in FIGS. 13-14, the whole leading inclined ramp portion 753 and 763 of each of the corresponding first and second dispenser nozzle outer shutter rails 750 and 760 extends beyond the leading edge 521 of the one or more sealing ribs 520 and the whole trailing inclined ramp portion 754 and 764 of each of the corresponding first and second dispenser nozzle outer shutter rails 750 and 760 extends beyond the trailing edge 522 of the one or more sealing ribs.

Referring now to FIG. 15, there is depicted a detached elevated top-down "birds-eye" view of a fourth embodiment of a particle dispenser cartridge 400 arranged with dispenser nozzle outer shutter rails 700, in accordance with the present invention. As shown, the reference line 92 intersects the included two dispenser nozzle outer shutter rails 7500 and 7600.

As shown in the present FIG. 15, the particle dispenser cartridge 400 includes a dispenser nozzle 500. The dispenser nozzle 500, in turn, includes plural sealing ribs 520' surrounding an included particle dispenser cartridge nozzle opening 420.

Still referring to FIG. 15, with momentary cross-reference to the foregoing descriptions of the first, second and third embodiments of the particle dispensing cartridge 400 arranged with dispenser nozzle outer shutter rails 700, in accordance with the present invention, in connection with FIGS. 7-14 above, the present FIG. 15 depicts the dispenser nozzle 500 as being arranged to engage a shutter 600. The shutter 600, in turn, is arranged to slide over the plural sealing ribs 520', thus sealing the particle dispenser cartridge nozzle opening 420. The dispenser nozzle 500 is further arranged so that when the particle dispenser cartridge 400 rotates about the particle dispenser cartridge axial 401 in a shutter-opening or leading direction (X) with respect to the shutter 600, the plural sealing ribs 520' move in a like direction with respect to the shutter 600, thus unsealing the particle dispenser cartridge nozzle opening 420.

Still referring to FIG. 15, the dispenser nozzle 500 includes a first dispenser nozzle outer shutter rail 7500 disposed on an inboard side 525 of the plural sealing ribs 520' and a second dispenser nozzle outer shutter rail 7600 disposed on the opposite outboard side 529 of the plural sealing ribs 520'. In turn, each of the first and second dispenser nozzle outer shutter rails 7500 and 7600 includes a corresponding leading rail end 7501 and 7601, a corresponding opposite trailing rail end 7502 and 7602, and a corresponding shutter rail length therebetween. As shown, both dispenser nozzle outer shutter rail leading rail ends 7501 and 7601 extend in the shutter-opening or leading direction (X) substantially to the leading edge 511 of the dispenser nozzle outer surface 510. Also as shown, both dispenser nozzle outer shutter rail trailing rail ends 7502 and 7602 extend in the opposite shutter-closing or trailing direction (X') substantially to the trailing edge 512 of the dispenser nozzle outer surface 510. As a result, both dispenser nozzle outer shutter rail leading rail ends 7501 and 7601 are substantially coincident with the leading edge 511 of the dispenser nozzle outer surface 510, and both dispenser nozzle outer shutter rail trailing rail ends 7502 and 7602 are substantially coincident with the trailing edge 512 of the dispenser nozzle outer surface 510.

Referring still to FIG. 15, the plural sealing ribs 520' comprise an outer sealing rib 530' and an inner sealing rib 540. The outer sealing rib 530', in turn, includes a leading outer sealing rib segment 531, a trailing outer sealing rib segment 532, an inboard outer sealing rib segment 535 and an outboard outer sealing rib segment 539. Also, the inner sealing rib 540, in turn, includes a leading inner sealing rib segment 541, a trailing inner sealing rib segment 542, an inboard inner sealing rib segment 545 and an outboard inner sealing rib segment 549.

As shown in FIG. 15, the leading outer sealing rib segment 531 is generally parallel to the corresponding leading inner sealing rib segment 541. Also, the trailing outer sealing rib segment 532 is generally parallel to the corresponding trailing inner sealing rib segment 542. Further, the inboard outer sealing rib segment 535 is generally parallel to the corresponding inboard inner sealing rib segment 545. Also, the outboard outer sealing rib segment 539 is generally parallel to the corresponding outboard inner sealing rib segment 549.

Still referring to FIG. 15, the inboard outer sealing rib segment 535 includes an inboard outer sealing rib segment extension 535.1 which, as shown, extends in the shutter-opening or leading direction (X) substantially to the leading edge 511 of the dispenser nozzle outer surface 510. Likewise, the outboard outer sealing rib segment 539 includes an outboard outer sealing rib segment extension 539.1 which, as shown, extends in the shutter-opening or leading direction (X) substantially to the leading edge 511 of the dispenser nozzle outer surface 510.

Further, the leading outer sealing rib segment 531 includes a first leading outer sealing rib segment extension 531.1, a second leading outer sealing rib segment extension 531.2 and a third leading outer sealing rib segment extension 531.3. As shown, these first, second and third leading outer sealing rib segment extensions 531.1, 531.2 and 531.3 extend for a finite distance in a direction generally orthogonal to the length of the leading outer sealing rib segment 531 and in a direction towards the facing leading edge 511 of the dispenser nozzle outer surface 510. Also as shown, the first, second and third leading outer sealing rib segment extensions 531.1, 531.2 and 531.3 are generally parallel to each other.

Referring still to FIG. 15, the first leading outer sealing rib segment extension 531.1 is generally aligned with the inboard inner sealing rib segment 545. Also, the second leading outer sealing rib segment extension 531.2 is generally aligned with the center of the particle dispenser cartridge nozzle opening 420. Further, the third leading outer sealing rib segment extension 531.3 is generally aligned with the outboard inner sealing rib segment 549.

Further, the trailing outer sealing rib segment 532 includes a first trailing outer sealing rib segment extension 532.1, a second trailing outer sealing rib segment extension 532.2 and a third trailing outer sealing rib segment extension 532.3. As shown, these first, second and third trailing outer sealing rib segment extensions 532.1, 532.2 and 532.3 extend in a direction generally orthogonal to the length of the trailing outer sealing rib segment 532 and in a direction towards the facing trailing edge 512 of the dispenser nozzle outer surface 510. Also as shown, the first, second and third trailing outer sealing rib segment extensions 532.1, 532.2 and 532.3 further extend substantially to the facing trailing edge 512 of the dispenser nozzle outer surface 510 and, as a result, the first, second and third trailing outer sealing rib segment extensions 532.1, 532.2 and 532.3 have respective distal ends that are substantially coincident with the facing trailing edge 512 of the dispenser nozzle outer surface 510. Moreover, as shown, the first, second and third trailing outer sealing rib segment extensions 532.1, 532.2 and 532.3 are generally parallel to each other.

Still referring to FIG. 15, the first trailing outer sealing rib segment extension 532.1 is generally aligned with the inboard inner sealing rib segment 545. Also, the second trailing outer sealing rib segment extension 532.2 is generally aligned with the center of the particle dispenser cartridge nozzle opening 420. Further, the third trailing outer sealing rib segment extension 532.3 is generally aligned with the outboard inner sealing rib segment 549.

As shown in FIG. 15, the first and second dispenser nozzle outer shutter rails 7500 and 7600 are generally parallel to each other.

Referring still to FIG. 15, similar to the foregoing description of the dispenser nozzle outer shutter rails 750 and 760 in connection with FIGS. 13-14 above, in one embodiment, each leading rail end 7501 and 7601 of the first and second dispenser nozzle outer shutter rails 7500 and 7600 is shaped to form a leading inclined ramp with respect to the dispenser nozzle outer surface 510. Further, in various embodiments, the leading ends of the foregoing first, second and third leading outer sealing rib segment extensions 531.1, 531.2 and 531.3 are likewise shaped to form corresponding leading inclined ramps with respect to the dispenser nozzle outer surface 510. Moreover, in various embodiments, the leading ends of the foregoing inboard and outboard outer sealing rib segment extensions 535.1 and 539.1 are also shaped to form corresponding leading inclined ramps with respect to the dispenser nozzle outer surface 510.

Referring still to FIG. 15, again similar to the foregoing description of the dispenser nozzle outer shutter rails 750 and 760 in connection with FIGS. 13-14 above, in one embodiment, each trailing rail end 7502 and 7602 of the first and second dispenser nozzle outer shutter rails 7500 and 7600 is shaped to form a trailing inclined ramp with respect to the dispenser nozzle outer surface 510. Further, in various embodiments, the trailing ends of the foregoing first, second and third trailing outer sealing rib segment extensions 532.1, 532.2 and 532.3 are likewise shaped to form corresponding trailing inclined ramps with respect to the dispenser nozzle outer surface 510.

Again similar to the foregoing description of the dispenser nozzle outer shutter rails 750 and 760 in connection with FIGS. 13-14 above, in one embodiment, the first and second dispenser nozzle outer shutter rails 7500 and 7600 have generally identical corresponding shapes and dimensions and further have a common dispenser nozzle outer shutter rail height that at least equals the corresponding height of the plural sealing ribs 520' with respect to the dispenser nozzle outer surface 510.

In conclusion, this invention is to make a change to the sealing rib area such that the hang-up performance of the cartridge 400 is improved and thereby extends the service life of defective dispensers. In one embodiment, the invention adds two pairs of outer shutter rails that act to bias the short cartridge sealing ribs, that is, the leading sealing ribs 521 and the trailing sealing ribs 522, away from the dispenser insert. This eliminates the chance for the short cartridge sealing ribs to catch on the insert in a defective dispenser. Thus, by eliminating the interference of the short sealing ribs with the insert, the cartridge cannot hang-up.

In summary, a cylindrical-shaped particle dispenser cartridge 400 includes a dispenser nozzle 500. The dispenser nozzle 500 outer surface 510 includes sealing ribs 520 or 520' that surround an included nozzle opening 420. The dispenser nozzle 500 is arranged to engage a shutter 600 that slides over the sealing ribs 520 or 520', thus sealing the nozzle opening 420. When the cartridge rotates about the cartridge axial 401 in a shutter-opening or leading direction (X) with respect to the shutter 600, the sealing ribs 520 or 520' move in a like direction with respect to the shutter 600, thus unsealing the particle dispenser cartridge nozzle opening 420. The dispenser cartridge 400 is arranged to dispense particles 2 including, but not limited to, toner particles. In accordance with the present invention, the dispenser nozzle outer surface 510 includes outer shutter rails 700 disposed on inboard 525 and outboard sides 529 of the sealing ribs 520 or 520'.

In a first embodiment, the outer shutter rails 700 comprise the shutter rails 710 and 720 described in connection with FIGS. 9-10 above.

In a second embodiment, the outer shutter rails 700 comprise the shutter rails 710, 720, 730 and 740 described in connection with FIGS. 11-12 above.

In a third embodiment, the outer shutter rails 700 comprise the shutter rails 750 and 760 described in connection with FIGS. 13-14 above.

In a fourth embodiment, the outer shutter rails 700 comprise the shutter rails 7500 and 7600 described in connection with FIG. 15 above.

Thus, there has been presented the first aspect of the invention, namely, a particle dispenser cartridge 400 having a dispenser nozzle 500, the dispenser nozzle 500 having one or more sealing ribs 520 surrounding an included particle dispenser cartridge nozzle opening 420, the dispenser nozzle 500 arranged to engage a shutter 600, the shutter arranged to slide over the one or more sealing ribs 520, thus sealing the particle dispenser cartridge nozzle opening 420, the dispenser nozzle 500 further arranged so that when the particle dispenser cartridge 400 rotates about the particle dispenser cartridge axial 401 in a shutter-opening or leading direction (X) with respect to the shutter 600, the one or more sealing ribs 520 move in a like direction with respect to the shutter 600, thus unsealing the particle dispenser cartridge nozzle opening 420; the dispenser nozzle 500 having a first dispenser nozzle outer shutter rail 710 disposed on an inboard side 525 of the one or more sealing ribs 520 and a second dispenser nozzle outer shutter rail 720 disposed on the opposite outboard side 529 of the one or more sealing ribs 520, with each of the first and second dispenser nozzle outer shutter rails 710 and 720 having a leading rail end 711 and 721 that extends beyond the leading edge 521 of the one or more sealing ribs 520 in the shutter-opening direction (X).

Also, there has been described the second aspect of the invention, namely, a particle dispenser cartridge 400 having a dispenser nozzle 500, the dispenser nozzle 500 having one or more sealing ribs 520 surrounding an included particle dispenser cartridge nozzle opening 420, the dispenser nozzle 500 arranged to engage a shutter 600, the shutter arranged to slide over the one or more sealing ribs 520, thus sealing the particle dispenser cartridge nozzle opening 420, the dispenser nozzle 500 further arranged so that when the particle dispenser cartridge 400 rotates about the particle dispenser cartridge axial 401 in a shutter-opening or leading direction (X) with respect to the shutter 600, the one or more sealing ribs 520 move in a like direction with respect to the shutter 600, thus unsealing the particle dispenser cartridge nozzle opening 420; the dispenser nozzle 500 having four dispenser nozzle outer shutter rails 710, 720, 730 and 740, with a first and a third dispenser nozzle outer shutter rails 710 and 730 disposed on an inboard side 525 of the one or more sealing ribs 520, and a second and a fourth dispenser nozzle outer shutter rails 720 and 740 disposed on the opposite outboard side 529 of the one or more sealing ribs 520, with each of the first and second dispenser nozzle outer shutter rails 710 and 720 having a leading rail end 711 and 721 that extends beyond the leading edge 521 of the one or more sealing ribs 520 in the shutter-opening direction (X), and each of the third and fourth dispenser nozzle outer shutter rails 730 and 740 having a trailing rail end 732 and 742 that extends beyond the trailing edge 522 of the one or more sealing ribs 520 in the opposite shutter-closing or trailing direction (X').

Also, there has been described the third aspect of the invention, namely, a particle dispenser cartridge 400 having a dispenser nozzle 500, the dispenser nozzle 500 having one or more sealing ribs 520 surrounding an included particle dispenser cartridge nozzle opening 420, the dispenser nozzle 500 arranged to engage a shutter 600, the shutter arranged to slide over the one or more sealing ribs 520, thus sealing the particle dispenser cartridge nozzle opening 420, the dispenser nozzle 500 further arranged so that when the particle dispenser cartridge 400 rotates about the particle dispenser cartridge axial 401 in a shutter-opening or leading direction (X) with respect to the shutter 600, the one or more sealing ribs 520 move in a like direction with respect to the shutter 600, thus unsealing the particle dispenser cartridge nozzle opening 420; the dispenser nozzle 500 having a first dispenser nozzle outer shutter rail 750 disposed on an inboard side 525 of the one or more sealing ribs 520 and a second dispenser nozzle outer shutter rail 760 disposed on the opposite outboard side 529 of the one or more sealing ribs 520, each of the first and second dispenser nozzle outer shutter rails 750 and 760 having a leading rail end 751 and 761, an opposite trailing rail end 752 and 762, and a shutter rail length therebetween, with each leading rail end 751 and 761 of the first and second dispenser nozzle outer shutter rails 750 and 760 extending beyond the leading edge 521 of the one or more sealing ribs 520 in the shutter-opening direction (X) and each trailing rail end 752 and 762 of the first and second dispenser nozzle outer shutter rails 750 and 760 extending beyond the trailing edge 522 of the one or more sealing ribs 520 in the opposite shutter-closing or trailing direction (X').

Also, there has been described the fourth aspect of the invention, namely, a particle dispenser cartridge 400 having a dispenser nozzle 500, the dispenser nozzle 500 having plural sealing ribs 520' surrounding an included particle dispenser cartridge nozzle opening 420, the dispenser nozzle 500 arranged to engage a shutter 600, the shutter arranged to slide over the plural sealing ribs 520', thus sealing the particle dispenser cartridge nozzle opening 420, the dispenser nozzle 500 further arranged so that when the particle dispenser cartridge 400 rotates about the particle dispenser cartridge axial 401 in a shutter-opening or leading direction (X) with respect to the shutter 600, the plural sealing ribs 520' move in a like direction with respect to the shutter 600, thus unsealing the particle dispenser cartridge nozzle opening 420; the dispenser nozzle 500 having a first dispenser nozzle outer shutter rail 7500 disposed on an inboard side 525 of the plural sealing ribs 520' and a second dispenser nozzle outer shutter rail 7600 disposed on the opposite outboard side 529 of the plural sealing ribs 520', each of the first and second dispenser nozzle outer shutter rails 7500 and 7600 having a leading rail end 7501 and 7601, an opposite trailing rail end 7502 and 7602, and a shutter rail length therebetween, with each leading rail end 7501 and 7601 of the first and second dispenser nozzle outer shutter rails 7500 and 7600 extending in the shutter-opening or leading direction (X) substantially to the leading edge 511 of an included dispenser nozzle outer surface 510, and each trailing rail end 7502 and 7602 of the first and second dispenser nozzle outer shutter rails 7500 and 7600 extending in the opposite shutter-closing or trailing direction (X') substantially to the trailing edge 512 of the dispenser nozzle outer surface 510.

The table below lists the drawing element reference numbers together with their corresponding written description:

| Ref. No.: | Description: |
|---|---|
| 2 | particles |
| 3 | particle flow |
| 10 | particle dispenser |
| 11 | particle dispenser housing |
| 12 | particle dispenser housing |
| 13 | sealing ribs leading edge contacting particle dispenser housing |
| 14 | particle dispenser inlet conduit |
| 91 | reference line, orthogonal to cartridge axial 101, parallel to cartridge inboard end 105, coincident with shutter outer surface 310 |
| 92 | reference line, parallel to cartridge axial 401, intersecting dispenser nozzle outlet conduit 414 |
| 93 | reference line, orthogonal to cartridge axial 401, parallel to cartridge inboard end 405, intersecting cartridge cylindrical housing 409 |
| 100 | particle dispenser cartridge |
| 101 | particle dispenser cartridge axial |
| 105 | particle dispenser cartridge inboard end |
| 109 | particle dispenser cartridge outboard end |
| 110 | particle dispenser cartridge outer surface |

-continued

| Ref. No.: | Description: |
|---|---|
| 114 | particle dispenser cartridge nozzle outlet conduit |
| 120 | particle dispenser cartridge nozzle opening |
| 121 | dispenser cartridge nozzle opening leading edge |
| 200 | dispenser nozzle |
| 210 | dispenser nozzle outer surface |
| 220 | sealing ribs |
| 221 | sealing ribs leading side or edge |
| 222 | sealing ribs trailing side or edge |
| 230 | outer sealing rib |
| 240 | inner sealing rib |
| 300 | shutter |
| 310 | shutter outer surface |
| 320 | shutter inner sealing surface |
| 400 | particle dispenser cartridge |
| 401 | particle dispenser cartridge axial |
| 405 | particle dispenser cartridge inboard end |
| 409 | particle dispenser cartridge cylindrical-shaped housing |
| 410 | particle dispenser cartridge outer surface |
| 414 | particle dispenser cartridge nozzle outlet conduit |
| 420 | particle dispenser cartridge nozzle opening |
| 421 | dispenser cartridge nozzle opening leading side or edge |
| 422 | dispenser cartridge nozzle opening trailing side or edge |
| 425 | dispenser cartridge nozzle opening inboard side or edge |
| 429 | dispenser cartridge nozzle opening outboard side or edge |
| 500 | dispenser nozzle |
| 510 | dispenser nozzle outer surface |
| 511 | dispenser nozzle outer surface leading side or edge |
| 512 | dispenser nozzle outer surface trailing side or edge |
| 515 | dispenser nozzle outer surface inboard side or edge |
| 519 | dispenser nozzle outer surface outboard side or edge |
| 520 | one or more sealing ribs |
| 520' | plural sealing ribs |
| 521 | sealing ribs leading side or edge |
| 522 | sealing ribs trailing side or edge |
| 523 | sealing rib height |
| 525 | sealing ribs inboard side or edge |
| 529 | sealing ribs outboard side or edge |
| 530 | outer sealing rib |
| 530' | outer sealing rib |
| 531 | leading outer sealing rib segment |
| 531.1 | first leading outer sealing rib segment extension |
| 531.2 | second leading outer sealing rib segment extension |
| 531.3 | third leading outer sealing rib segment extension |
| 532 | trailing outer sealing rib segment |
| 532.1 | first trailing outer sealing rib segment extension |
| 532.2 | second trailing outer sealing rib segment extension |
| 532.3 | third trailing outer sealing rib segment extension |
| 535 | inboard outer sealing rib segment |
| 535.1 | inboard outer sealing rib segment extension |
| 539 | outboard outer sealing rib segment |
| 539.1 | outboard outer sealing rib segment extension |
| 540 | inner sealing rib |
| 541 | leading inner sealing rib segment |
| 542 | trailing inner sealing rib segment |
| 545 | inboard inner sealing rib segment |
| 549 | outboard inner sealing rib segment |
| 600 | shutter |
| 601 | shutter leading rail end |
| 602 | shutter trailing rail end |
| 605 | shutter inboard side or edge |
| 609 | shutter outboard side or edge |
| 610 | shutter outer surface |
| 620 | shutter inner sealing surface |
| 700 | dispenser nozzle outer shutter rails |
| 710 | inboard leading dispenser nozzle outer shutter rail |
| 711 | dispenser nozzle outer shutter rail leading rail end |
| 712 | dispenser nozzle outer shutter rail trailing rail end |
| 713 | dispenser nozzle outer shutter rail leading inclined ramp |
| 714 | dispenser nozzle outer shutter rail trailing inclined ramp |
| 715 | dispenser nozzle outer shutter rail height |
| 720 | outboard leading dispenser nozzle outer shutter rail |
| 721 | dispenser nozzle outer shutter rail leading rail end |
| 722 | dispenser nozzle outer shutter rail trailing rail end |
| 723 | dispenser nozzle outer shutter rail leading inclined ramp |
| 724 | dispenser nozzle outer shutter rail trailing inclined ramp |
| 725 | dispenser nozzle outer shutter rail height |
| 730 | inboard trailing dispenser nozzle outer shutter rail |

-continued

| Ref. No.: | Description: |
|---|---|
| 731 | dispenser nozzle outer shutter rail leading rail end |
| 732 | dispenser nozzle outer shutter rail trailing rail end |
| 733 | dispenser nozzle outer shutter rail leading inclined ramp |
| 734 | dispenser nozzle outer shutter rail trailing inclined ramp |
| 735 | dispenser nozzle outer shutter rail height |
| 740 | outboard trailing dispenser nozzle outer shutter rail |
| 741 | dispenser nozzle outer shutter rail leading rail end |
| 742 | dispenser nozzle outer shutter rail trailing rail end |
| 743 | dispenser nozzle outer shutter rail leading inclined ramp |
| 744 | dispenser nozzle outer shutter rail trailing inclined ramp |
| 745 | dispenser nozzle outer shutter rail height |
| 750 | inboard dispenser nozzle outer shutter rail |
| 751 | dispenser nozzle outer shutter rail leading rail end |
| 752 | dispenser nozzle outer shutter rail trailing rail end |
| 753 | dispenser nozzle outer shutter rail leading inclined ramp |
| 754 | dispenser nozzle outer shutter rail trailing inclined ramp |
| 755 | dispenser nozzle outer shutter rail height |
| 760 | outboard dispenser nozzle outer shutter rail |
| 761 | dispenser nozzle outer shutter rail leading rail end |
| 762 | dispenser nozzle outer shutter rail trailing rail end |
| 763 | dispenser nozzle outer shutter rail leading inclined ramp |
| 764 | dispenser nozzle outer shutter rail trailing inclined ramp |
| 765 | dispenser nozzle outer shutter rail height |
| 7500 | inboard dispenser nozzle outer shutter rail |
| 7501 | dispenser nozzle outer shutter rail leading rail end |
| 7502 | dispenser nozzle outer shutter rail trailing rail end |
| 7600 | outboard dispenser nozzle outer shutter rail |
| 7601 | dispenser nozzle outer shutter rail leading rail end |
| 7602 | dispenser nozzle outer shutter rail trailing rail end |

While various embodiments of a particle dispenser cartridge arranged with dispenser nozzle outer shutter rails, in accordance with the present invention, have been described hereinabove, the scope of the invention is defined by the following claims.

What is claimed is:

1. A particle dispenser cartridge comprising a dispenser nozzle, the dispenser nozzle comprising a dispenser nozzle outer surface and one or more sealing ribs extending from said dispenser nozzle outer surface and surrounding an included particle dispenser cartridge nozzle opening, the dispenser nozzle arranged to engage a shutter, the shutter arranged to slide over the one or more sealing ribs, thus sealing the particle dispenser cartridge nozzle opening, the dispenser nozzle further arranged so that when the particle dispenser cartridge rotates about the particle dispenser cartridge axial in a shutter-opening or leading direction (X) with respect to the shutter, the one or more sealing ribs move in a like direction with respect to the shutter, thus unsealing the particle dispenser cartridge nozzle opening;

the dispenser nozzle comprising a first dispenser nozzle outer shutter rail extending from said dispenser nozzle outer surface on an inboard side of the one or more sealing ribs and a second dispenser nozzle outer shutter rail extending from said dispenser nozzle outer surface on the opposite outboard side of the one or more sealing ribs, each of the first and second dispenser nozzle outer shutter rails comprising a height from said dispenser nozzle outer surface that at least equals a height from said dispenser nozzle outer surface of the sealing ribs and a leading rail end that extends beyond the leading edge of the one or more sealing ribs in the shutter-opening direction (X), said first and second outer shuttle rails biasing said sealing ribs away from said shutter.

2. The particle dispenser cartridge of claim 1, the first and second dispenser nozzle outer shutter rails being generally parallel to each other.

3. The particle dispenser cartridge of claim 2, each leading rail end of the first and second dispenser nozzle outer shutter rails being shaped to form a corresponding leading inclined ramp with respect to an included dispenser nozzle outer surface.

4. The particle dispenser cartridge of claim 3, each of the first and second dispenser nozzle outer shutter rails comprising a trailing rail end opposite its leading rail end, and a shutter rail length therebetween, each trailing rail end of the first and second dispenser nozzle outer shutter rails extending beyond the leading edge of the particle dispenser cartridge nozzle opening in the opposite shutter-closing or trailing direction (X').

5. The particle dispenser cartridge of claim 4, each trailing rail end of the first and second dispenser nozzle outer shutter rails being shaped to form a corresponding trailing inclined ramp with respect to the dispenser nozzle outer surface.

6. The particle dispenser cartridge of claim 4, each leading rail end of the first and second dispenser nozzle outer shutter rails extending an equal distance beyond the leading edge of the one or more sealing ribs.

7. The particle dispenser cartridge of claim 4, the first and second dispenser nozzle outer shutter rails comprising generally identical corresponding shapes and dimensions and further comprising a common dispenser nozzle outer shutter rail height that at least equals the corresponding height of the one or more sealing ribs with respect to the dispenser nozzle outer surface.

8. The particle dispenser cartridge of claim 4, the one or more sealing ribs comprising exactly two (2) sealing ribs.

9. A particle dispenser cartridge comprising a dispenser nozzle, the dispenser plural sealing ribs surrounding an included particle dispenser cartridge nozzle opening, the dispenser nozzle comprising a dispenser nozzle outer surface and being arranged to engage a shutter, the shutter arranged to slide over the plural sealing ribs extending from said dispenser nozzle outer surface, thus sealing the particle dispenser cartridge nozzle opening, the dispenser nozzle further arranged so that when the particle dispenser cartridge rotates about the particle dispenser cartridge axial in a shutter-opening or leading direction (X) with respect to the shutter, the plural sealing ribs move in a like direction with respect to the shutter, thus unsealing the particle dispenser cartridge nozzle opening;

the dispenser nozzle comprising a first dispenser nozzle outer shutter rail extending from said dispenser nozzle outer surface on an inboard side of the plural sealing ribs and a second dispenser nozzle outer shutter rail extending from said dispenser nozzle outer surface on the opposite outboard side of the plural sealing ribs, each of the first and second dispenser nozzle outer shutter rails comprising a leading rail end, an opposite trailing rail end, and a shutter rail length therebetween, each leading rail end of the first and second dispenser nozzle outer shutter rails extending in the shutter-opening or leading direction (X) substantially to the leading edge of an included dispenser nozzle outer surface, each trailing rail end of the first and second dispenser nozzle outer shutter rails extending in the opposite shutter-closing or trailing direction (X') substantially to the trailing edge of the dispenser nozzle outer surface, and each of the first and second dispenser nozzle outer shutter rails comprising a height from said dispenser nozzle outer surface that at least equals a height from said dispenser nozzle outer surface of the sealing, said first and second outer shuttle rails biasing said sealing ribs away from said shutter.

10. The particle dispenser cartridge of claim 9, the plural sealing ribs comprising an outer sealing rib and an inner sealing rib;

the outer sealing rib comprising a leading outer sealing rib segment, a trailing outer sealing rib segment, an inboard outer sealing rib segment and an outboard outer sealing rib segment;

the inner sealing rib comprising a leading inner sealing rib segment, a trailing inner sealing rib segment, an inboard inner sealing rib segment and an outboard inner sealing rib segment;

each of the inboard and outboard outer sealing rib segments being generally parallel to its corresponding respective inboard and outboard inner sealing rib segment;

the inboard outer sealing rib segment comprising an inboard outer sealing rib segment extension and the outboard outer sealing rib segment comprising an outboard outer sealing rib segment extension, each of the inboard and outboard outer sealing rib segment extensions extending in the shutter-opening direction (X) substantially to the leading edge of the dispenser nozzle outer surface.

11. The particle dispenser cartridge of claim 10, the leading outer sealing rib segment comprising a first, a second and a third leading outer sealing rib segment extensions extending in a direction generally orthogonal to the length of the leading outer sealing rib segment and towards the leading edge of the dispenser nozzle outer surface;

the first leading outer sealing rib segment extension being generally aligned with the inboard inner sealing rib segment;

the second leading outer sealing rib segment extension being generally aligned with the center of the particle dispenser cartridge nozzle opening; and the third leading outer sealing rib segment extension being generally aligned with the outboard inner sealing rib segment.

12. The particle dispenser cartridge of claim 11, the trailing outer sealing rib segment comprising a first, a second and a third trailing outer sealing rib segment extensions extending in a direction generally orthogonal to the length of the trailing outer sealing rib segment and towards the trailing edge of the dispenser nozzle outer surface;

the first trailing outer sealing rib segment extension being generally aligned with the inboard inner sealing rib segment;

the second trailing outer sealing rib segment extension being generally aligned with the center of the particle dispenser cartridge nozzle opening; and the third trailing outer sealing rib segment extension being generally aligned with the outboard inner sealing rib segment.

13. The particle dispenser cartridge of claim 12, the first and second dispenser nozzle outer shutter rails being generally parallel to each other.

14. The particle dispenser cartridge of claim 13, each leading rail end of the first and second dispenser nozzle outer shutter rails being shaped to form a corresponding leading inclined ramp with respect to the dispenser nozzle outer surface.

15. The particle dispenser cartridge of claim 13, each trailing rail end of the first and second dispenser nozzle outer shutter rails being shaped to form a corresponding trailing inclined ramp with respect to the dispenser nozzle outer surface.

16. The particle dispenser cartridge of claim 13, the first and second dispenser nozzle outer shutter rails comprising generally identical corresponding shapes and dimensions and further comprising a common dispenser nozzle outer shutter rail height.

17. A particle dispenser cartridge comprising a dispenser nozzle, the dispenser nozzle comprising a dispenser nozzle outer surface and one or more sealing ribs extending from said dispenser nozzle outer surface and surrounding an included particle dispenser cartridge nozzle opening, the dispenser nozzle arranged to engage a shutter, the shutter arranged to slide over the one or more sealing ribs, thus sealing the particle dispenser cartridge nozzle opening, the dispenser nozzle further arranged so that when the particle dispenser cartridge rotates about the particle dispenser cartridge axial in a shutter-opening or leading direction (X) with respect to the shutter, the one or more sealing ribs move in a like direction with respect to the shutter, thus unsealing the particle dispenser cartridge nozzle opening;

the dispenser nozzle comprising a first dispenser nozzle outer shutter rail extending from said dispenser nozzle outer surface on an inboard side of the one or more sealing ribs and a second dispenser nozzle outer shutter rail extending from said dispenser nozzle outer surface on the opposite outboard side of the one or more sealing ribs, each of the first and second dispenser nozzle outer shutter rails comprising a height from said dispenser nozzle outer surface that at least equals a height from said dispenser nozzle outer surface of the sealing ribs and a leading rail end that extends beyond the leading edge of the one or more sealing ribs in the shutter-opening direction (X) in which said sealing ribs are biased away from said shutter by said first and second rails.

* * * * *